US010514624B2

(12) United States Patent
Tamura et al.

(10) Patent No.: US 10,514,624 B2
(45) Date of Patent: Dec. 24, 2019

(54) TONER

(71) Applicant: CANON KABUSHIKI KAISHA, Tokyo (JP)

(72) Inventors: Junichi Tamura, Toride (JP); Hayato Ida, Toride (JP); Kentaro Kamae, Kashiwa (JP); Ryuji Murayama, Nagareyama (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/148,446

(22) Filed: Oct. 1, 2018

(65) Prior Publication Data

US 2019/0107793 A1 Apr. 11, 2019

(30) Foreign Application Priority Data

Oct. 5, 2017 (JP) ..... 2017-195160

(51) Int. Cl.
*G03G 9/097* (2006.01)
*G03G 9/087* (2006.01)

(52) U.S. Cl.
CPC ..... *G03G 9/09775* (2013.01); *G03G 9/08724* (2013.01)

(58) Field of Classification Search
CPC ..... G03G 9/09775; G03G 9/08724
See application file for complete search history.

(56) References Cited

U.S. PATENT DOCUMENTS

| | | | |
|---|---|---|---|
| 8,084,174 | B2 | 12/2011 | Hasegawa et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,974,994 | B2 | 3/2015 | Kamae et al. |
| 8,986,914 | B2 | 3/2015 | Fujikawa et al. |
| 9,057,970 | B2 | 6/2015 | Ida et al. |
| 9,058,924 | B2 | 6/2015 | Komatsu et al. |
| 9,063,443 | B2 | 6/2015 | Ishigami et al. |
| 9,348,247 | B2 | 5/2016 | Ida et al. |
| 9,540,483 | B2 | 1/2017 | Ida et al. |
| 9,665,023 | B2 | 5/2017 | Kamae et al. |
| 9,696,644 | B2 | 7/2017 | Ida et al. |
| 9,897,934 | B2 | 2/2018 | Tamura et al. |
| 9,915,885 | B2 | 3/2018 | Katsumata et al. |
| 9,958,800 | B2 * | 5/2018 | Chimoto ..... G03G 9/0804 |
| 9,969,834 | B2 | 5/2018 | Ohtsu et al. |
| 10,012,918 | B2 | 7/2018 | Ishigami et al. |
| 10,012,920 | B2 | 7/2018 | Shibata et al. |
| 10,012,921 | B2 | 7/2018 | Kamae et al. |
| 10,078,281 | B2 | 9/2018 | Ida et al. |
| 10,088,765 | B2 | 10/2018 | Miyakai et al. |
| 2013/0108955 | A1 | 5/2013 | Shibata et al. |
| 2013/0202998 | A1 | 8/2013 | Higashi et al. |
| 2013/0244159 | A1 | 9/2013 | Ishigami et al. |
| 2014/0134535 | A1 | 5/2014 | Baba et al. |
| 2015/0099227 | A1 | 4/2015 | Ida et al. |
| 2016/0349645 | A1 * | 12/2016 | Murayama ..... G03G 9/08724 |
| 2017/0269493 | A1 | 9/2017 | Ohtsu et al. |
| 2018/0031990 | A1 | 2/2018 | Kamae et al. |
| 2018/0052402 | A1 | 2/2018 | Iwasaki et al. |
| 2018/0067410 | A1 | 3/2018 | Yamashita et al. |
| 2018/0149990 | A1 | 5/2018 | Onozaki et al. |
| 2018/0149992 | A1 | 5/2018 | Onozaki et al. |
| 2018/0203370 | A1 | 7/2018 | Tamura et al. |
| 2018/0275540 | A1 | 9/2018 | Matsuo et al. |

FOREIGN PATENT DOCUMENTS

| | | | |
|---|---|---|---|
| JP | H04120554 | A | 4/1992 |
| JP | 2004198762 | A | 7/2004 |
| JP | 2006276074 | A | 10/2006 |

* cited by examiner

*Primary Examiner* — Thorl Chea
(74) *Attorney, Agent, or Firm* — Venable LLP

(57) ABSTRACT

A toner comprising: a toner particle that contains a resin component and a silicone compound, wherein the resin component contains at least 50 mass % of olefin resin; a content of the silicone compound is from 1 mass part to 42 mass parts per 100 mass parts of the resin component; a weight-average molecular weight of the silicone compound as measured by GPC is from 1,000 to 25,000; and a content, in a molecular weight distribution of the silicone compound as measured by GPC, of a component having a weight-average molecular weight of not more than 500 is not more than 0.05 mass % of the silicone compound.

12 Claims, No Drawings

TONER

BACKGROUND OF THE INVENTION

Field of the Invention

The present invention relates to a toner used in electrophotography.

Description of the Related Art

Efforts to further lower the fixation temperature of toners have accompanied the increased requirements of recent years for greater energy savings during image formation. With regard to methods for improving the low-temperature fixability, Japanese Patent Application Laid-open No. H04-120554 discloses technique in which a crystalline polyester resin that exhibits a sharp melt property, i.e., its viscosity undergoes a substantial decline when its melting point is exceeded, is incorporated in a toner particle as a plasticizer.

However, conventional crystalline polyester resins have a glass transition temperature Tg that does not exceed room temperature and contain polar groups, e.g., an ester group. As a consequence, the volume resistivity has tended to be low and in particular there have been problems with toner charge retention in high-humidity environments.

As one means for addressing this, Japanese Patent Application Laid-open No. 2006-276074 proposes a method for reducing toner hygroscopicity and thereby improving toner charge stability by incorporating, as the binder resin that is the major component of toner, a low-polarity olefin resin as typified by cyclic olefin resins.

However, when these low-polarity olefin resins are used as the main binder, because their SP values are close to those of the heretofore used release agents, e.g., alkyl waxes, an adequate exudation of the release agent during fixing does not occur and the hot offset resistance then ends up declining.

Toners have thus been proposed that use silicone oil, which exhibits a large difference in SP value from olefin resins, as the release agent, such as disclosed in Japanese Patent Application Laid-open No. 2004-198762.

SUMMARY OF THE INVENTION

Toner exhibiting an excellent low-temperature fixability and an improved hot offset resistance is obtained by using an olefin resin as the main resin and using, as the release agent, a silicone compound having the siloxane bond in the main skeleton, such as a silicone oil.

However, it was found that even when a silicone compound is used, the hot offset resistance cannot be regarded as satisfactory, while conversely the storability and charge retention end up declining.

As a result of their investigations, the present inventors found that when a conventional silicone compound is used, a portion of the component precipitates at the toner particle surface, causing a decline in the storability and charge retention.

An object of the present invention is to provide a toner that exhibits an excellent low-temperature fixability, an excellent storability, an excellent charge retention, and an excellent hot offset resistance.

As a result of intensive investigations, the present inventors found that, with regard to toner that uses an olefin resin as a resin component and a silicone compound as a release agent, a toner having an excellent low-temperature fixability, an excellent storability, an excellent charge retention, and an excellent hot offset resistance is obtained through control of the molecular weight of the silicone compound.

Thus, the present invention relates to a toner having: a toner particle that contains a resin component and a silicone compound, wherein the resin component contains at least 50 mass % olefin resin; a content of the silicone compound is from 1 mass part to 42 mass parts per 100 mass parts of the resin component; a weight-average molecular weight of the silicone compound as measured by GPC is from 1,000 to 25,000; and a content, in a molecular weight distribution of the silicone compound as measured by GPC, of a component having a weight-average molecular weight of not more than 500 is not more than 0.05 mass % of the silicone compound.

The present invention can thus provide a toner that exhibits an excellent low-temperature fixability, an excellent storability, an excellent charge retention, and an excellent hot offset resistance.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

In the present invention, the resin component of the toner particle primarily refers to a polymeric component that contributes to the ability to undergo fixing. This resin component contains the olefin resin.

Olefin Resin

The olefin resin is specifically exemplified by homopolymers of α-olefins such as ethylene, propylene, 1-butene, 1-hexene, and 4-methyl-1-pentene; copolymers of two or more species of α-olefin; copolymers of an α-olefin with a vinyl monomer such as vinyl acetate or methyl acrylate; and the polymers yielded by the ring-opening polymerization of cyclic olefin and the polymers obtained by hydrogenation after the copolymerization of cyclic olefin with α-olefin.

The olefin resin may be an amorphous resin such as a cyclic olefin resin or may be a crystalline resin such as polyethylene, polypropylene, or an ethylene-vinyl acetate resin. It is known that generally the low-temperature fixability of a toner improves as the glass transition temperature declines.

Crystalline olefin polymers as represented by polyethylene and polypropylene, ester group-bearing crystalline olefin copolymers as represented by ethylene-vinyl acetate copolymers, and acid group-bearing crystalline olefin copolymers as represented by ethylene-acrylic acid copolymers and ethylene-methacrylic acid copolymers can contribute to storability through crystallization even though the glass transition temperature may be at or below room temperature, and as a consequence are preferably used from the standpoint of being able to achieve both low-temperature fixability and storability in good balance. Among the preceding, ester group-bearing crystalline olefin copolymers can be designed to have low melting points and as a consequence are preferred from the standpoint of the low-temperature fixability. Moreover, ethylene-vinyl acetate copolymers can be designed to have low melting points and low polarities and as a consequence are more preferred from the standpoints of the low-temperature fixability and the charge retention.

When the olefin resin is a crystalline resin, its melting point is preferably from 50° C. to 110° C. An excellent storability is obtained at 50° C. and above. On the other hand, an excellent low-temperature fixability is obtained when the melting point is not more than 110° C. The melting point is more preferably at least 60° C. from the standpoint of the storability. On the other hand, the melting point is more preferably not more than 100° C. from the standpoint of the low-temperature fixability.

A satisfactory storability is obtained when the crystalline resin has a melting point in the indicated range even though its glass transition temperature may be at or below 0° C. Here, crystalline resin refers to a resin that has a distinct melting point in measurement by differential scanning calorimetry (DSC).

The melting point of the resin, e.g., crystalline resin, can be measured using differential scanning calorimetry (DSC).

Specifically, 0.01 g to 0.02 g is exactly weighed out into an aluminum pan and the DSC curve is obtained by raising the temperature from 0° C. to 200° C. at a ramp rate of 10° C./min.

The peak temperature of the melting endothermic peak in the resulting DSC curve is the melting point.

The ester group concentration in the olefin copolymer including ester group, expressed with reference to the total mass of the olefin copolymer including ester group, is preferably not more than 18 mass %. Not more than 10 mass % is more preferred. While there are no particular limitations on the lower limit, it is preferably at least 2 mass % and is more preferably at least 3 mass %.

In the present invention, the ester group concentration is the value that gives the content in mass % of the ester group [—C(=O)O—] bond segment in the olefin copolymer including ester group, and the method for determining the ester group concentration is described below.

The low-temperature fixability and charge retention are excellent when the ester group concentration is in the indicated range.

Olefin copolymers including ester group, which are preferred among olefin resins for use in the present invention, are described in detail in the following.

A preferred example of the olefin copolymer including ester group is copolymer having the structure Y1 represented by formula (1) below and having at least one species of structure Y2 selected from the group consisting of the structure represented by the following formula (2) and the structure represented by the following formula (3). In the formulas, $R^1$ represents H or $CH_3$; $R^2$ represents H or $CH_3$; $R^3$ represents $CH_3$ or $C_2H_5$; $R^4$ represents H or $CH_3$; and $R^5$ represents $CH_3$ or $C_2H_5$.

The copolymer more preferably has a formula (1) structure in which $R^1$ is H and a formula (2) structure in which $R^2$ is H and $R^3$ is $CH_3$. Such a copolymer is referred to as an ethylene-vinyl acetate copolymer. Ethylene-vinyl acetate copolymers can be designed to have low melting points and as a consequence are preferred from the standpoint of the low-temperature fixability.

(1)

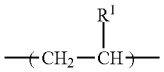

-continued (2)

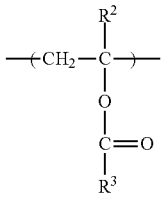

(3)

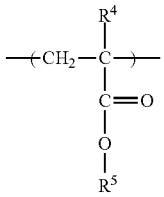

Another preferred example of the olefin copolymer including ester group is described as follows.

This is a copolymer having a formula (1) structure in which $R^1$ is H and a formula (3) structure in which $R^4$ is H and $R^5$ is $CH_3$. Such a copolymer is referred to as an ethylene-methyl acrylate copolymer.

Yet another preferred example of the olefin copolymer including ester group is described as follows.

This is a copolymer having a formula (1) structure in which $R^1$ is H and a formula (3) structure in which $R^4$ is H and $R^5$ is $C_2H_5$. Such a copolymer is referred to as an ethylene-ethyl acrylate copolymer.

Yet another preferred example of the olefin copolymer including ester group is described as follows.

This is a copolymer having a formula (1) structure in which $R^1$ is H and a formula (3) structure in which $R^4$ is $CH_3$ and $R^5$ is $CH_3$. Such a copolymer is referred to as an ethylene-methyl methacrylate copolymer.

Ethylene-methyl acrylate copolymers, ethylene-ethyl acrylate copolymers, and ethylene-methyl methacrylate copolymers have high chemical stabilities and as a consequence are preferred from the standpoint of toner storability in high-temperature, high-humidity environments.

The resin component may contain a single species or a plurality of species of olefin copolymer including ester group.

Using W for the sum total mass of the olefin copolymer including ester group, 1 for the mass of the structure represented by formula (1), m for the mass of the structure represented by formula (2), and n for the mass of the structure represented by formula (3), the value of (1+m+n)/W, viewed from the perspective of the low-temperature fixability and charge retention, is preferably from 0.80 to 1.00, more preferably from 0.95 to 1.00, and even more preferably is 1.00.

The olefin copolymer including ester group may contain a structure other than the structures represented by formulas (1), (2), and (3). Examples in this regard are the structure represented by formula (4) below and the structure represented by formula (5) below. These can be introduced by the addition of monomer corresponding to the particular structure to the copolymerization reaction that produces the olefin copolymer including ester group. They can also be introduced through modification of the olefin copolymer including ester group using monomer corresponding to the particular structure.

(4)

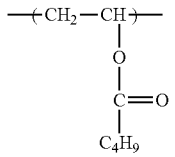

(5)

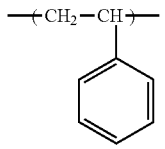

Viewed from the standpoint of charge retention, the acid value of the olefin copolymer including ester group is preferably from 0 mg KOH/g to 10 mg KOH/g and more preferably from 0 mg KOH/g to 5 mg KOH/g and is still more preferably substantially 0 mg KOH/g.

Viewed from the standpoint of the low-temperature fixability of the toner, olefin resin (preferably olefin copolymer including ester group) is used as the main resin of the toner particle in the present invention. The content of the olefin resin (preferably olefin copolymer including ester group) must be at least 50 mass % with reference to the total mass of the resin component. At least 70 mass % is more preferred. The upper limit is not particularly limited, but is preferably not more than 90 mass % and is more preferably not more than 80 mass %. An excellent low-temperature fixability is provided by having the olefin resin (preferably olefin copolymer including ester group) have a glass transition temperature preferably of not more than 0° C. and by having its content in the resin component be at least 50 mass %.

From the standpoint of charge retention, the content in the olefin copolymer including ester group of the structures represented by formula (2) and formula (3), expressed with reference to the total mass of the olefin copolymer including ester group, is preferably from 3 mass % to 35 mass %. From 5 mass % to 20 mass % is more preferred. A good toner charge retention is obtained at not more than 35 mass %. On the other hand, an excellent adherence for paper and an excellent low-temperature fixability are provided when this content is at least 3 mass %.

For example, in the case of an ethylene-vinyl acetate copolymer, the content of the vinyl acetate-derived structure in the ethylene-vinyl acetate copolymer, expressed with reference to the total mass of the ethylene-vinyl acetate copolymer, is preferably from 3 mass % to 35 mass %. The masses 1, m, and n for each structure and the content of the structures with formulas (2) and (3) can be measured using ordinary analytical procedures; for example, nuclear magnetic resonance (NMR) or pyrolysis gas chromatography can be used.

Measurement by $^1$H-NMR is carried out using the following procedure.

The content ratios for the individual structures can be determined by comparing the respective integration values for the hydrogen atoms in the structure represented by formula (1), the hydrogen atoms in $R^3$ in the structure represented by formula (2), and the hydrogen atoms in $R^5$ in the structure represented by formula (3).

For example, the content ratios of the individual structures in an ethylene-vinyl acetate copolymer (ratio for the unit derived from vinyl acetate:15 mass %) can be determined using the following procedure.

instrument: JNM-ECZR series FT-NMR (JEOL)

A solution of approximately 5 mg of the sample dissolved in 0.5 mL of deuterated acetone containing tetramethylsilane as the 0.00 ppm internal reference is introduced into a sample tube, and the $^1$H-NMR spectrum is measured using conditions of a repeat time of 2.7 s and 16 cumulations.

The peak at 1.14 to 1.36 ppm corresponds to the $CH_2$—$CH_2$ in the ethylene-derived structure. The peak around 2.04 ppm corresponds to the $CH_3$ in the vinyl acetate-derived structure. The content ratio for each structure can be calculated by calculating the ratio between the integration values for these peaks.

In addition, the ester group concentration is determined using the following procedure.

$$\text{ester group concentration (unit: mass \%)} = [(N \times 44)/\text{number-average molecular weight}] \times 100$$

Here, N is the average number of ester groups per molecule of the olefin copolymer including ester group, and 44 is the formula weight of the ester group [—C(=O)O—].

The olefin resin (preferably olefin copolymer including ester group) preferably has a melt flow rate (MFR) of from 5 g/10 min to 30 g/10 min. Reductions in toner strength and blocking during storage are both suppressed when the melt flow rate is not more than 30 g/10 min. In addition, the melt flow rate is more preferably not more than 20 g/10 min from the standpoint of the ability of the toner to withstand impact and pressure during use.

The melt flow rate is preferably at least 5 g/10 min from the standpoint of the image gloss.

The melt flow rate is measured based on JIS K 7210 using conditions of a temperature of 190° C. and a load of 2,160 g. When a plurality of olefin resins are incorporated in the resin component, measurement is carried out under the indicated conditions after melt-mixing has been performed.

The melt flow rate can be controlled by changing the molecular weight of the resin. The melt flow rate can be reduced by raising the molecular weight.

The molecular weight of the olefin resin (preferably olefin copolymer including ester group), expressed as the weight-average molecular weight, is preferably at least 50,000 and is more preferably at least 100,000.

While the upper limit is not particularly limited, the weight-average molecular weight is preferably not more than 500,000 from the standpoint of image gloss.

The olefin resin (preferably olefin copolymer including ester group) preferably has an elongation at break of at least 300% and more preferably at least 500%. The fixed material is provided with an excellent bending resistance by having the elongation at break be at least 300%. The upper limit on this elongation at break is approximately not more than 1,000%.

The elongation at break is measured using conditions based on JIS K 7162. When a plurality of olefin resins are incorporated in the resin component, measurement is carried out under the indicated conditions after melt-mixing has been performed.

When the olefin resin is an amorphous resin, a cyclic olefin resin is preferably used from the standpoint of the insulating characteristics. Cyclic olefin resins can be specifically exemplified by polymers obtained by the ring-opening polymerization of cyclic olefin and polymers obtained by copolymerizing cyclic olefin with α-olefin followed by hydrogenation.

The following are examples of commercially available cyclic olefin resin products: ZEONEX [product name] (Zeon Corporation), APEL [product name] (Mitsui Chemicals, Inc.), ARTON [product name] (JSR Corporation), and TOPAS [product name] (Polyplastics Co., Ltd.).

The cyclic olefin resin may be a blend of several species of polymers or may be a copolymer of a plurality of monomer species. When a plurality of copolymer species are used, there are no particular limitations on the repetition of the constituent units of the polymers forming this. For example, an alternating structure, random structure, or block structure in each case may by itself form the periodic structure in a polymer, or the polymer chain may be formed by a combination of the preceding. Crosslinking structures may also be present in the polymer.

When the olefin resin is an amorphous resin, the glass transition temperature is preferably from 30° C. to 80° C.

The storability is enhanced when the glass transition temperature is at least 30° C. On the other hand, the low-temperature fixability is enhanced when the glass transition temperature is not more than 80° C. The glass transition temperature is more preferably at least 40° C. from the standpoint of the storability. On the other hand, the glass transition temperature is more preferably not more than 70° C. from the standpoint of the low-temperature fixability.

The glass transition temperature (Tg) can be measured using a differential scanning calorimeter (Mettler-Toledo: DSC822/EK90).

Specifically, 0.01 to 0.02 g of the sample is exactly weighed into an aluminum pan and the temperature is raised from 25° C. to 200° C. at a ramp rate of 10° C./min. Cooling is then carried out from 200° C. to −100° C. at a ramp down rate of 10° C./min, and the DSC curve is obtained by reheating from −100° C. to 200° C. at a ramp rate of 10° C./min.

The glass transition temperature is the temperature in the resulting DSC curve at the intersection between the straight line provided by extending the low-temperature-side baseline to the high temperature side, and the tangent line drawn at the point of the maximum slope in the curve segment for the stepwise change at the glass transition.

The softening temperature (Tm) of the olefin resin is preferably from 70° C. to 150° C., more preferably from 80° C. to 140° C., and still more preferably from 80° C. to 130° C.

When the softening temperature (Tm) is in the indicated temperature range, an excellent coexistence between the blocking resistance and offset resistance is set up; in addition, a favorable penetration by the toner melt component into the paper is obtained during fixing under the application of heat and an excellent surface smoothness is obtained.

The softening point (Tm) of the olefin resin can be measured using a "Flowtester CFT-500D Flow Property Evaluation Instrument" (Shimadzu Corporation), which is a constant-load extrusion-type capillary rheometer.

The CFT-500D is an instrument that, while applying a constant load by a piston from the top of a measurement sample filled in a cylinder, can heat and melt the measurement sample and extrude it from a capillary orifice at the bottom of the cylinder, and can graph out a flow curve from the piston stroke (mm) and the temperature (° C.) during this process. The "melting temperature by the ½ method", as described in the manual provided with the "Flowtester CFT-500D Flow Property Evaluation Instrument", is taken to be the softening temperature (Tm) in the present invention.

The melting temperature by the ½ method is determined as follows.

First, ½ of the difference between the piston stroke at the completion of outflow (outflow completion point, designated Smax) and the piston stroke at the start of outflow (minimum point, designated Smin) is determined (this value is designated as X, where X=(Smax−Smin)/2). The temperature in the flow curve when the piston stroke reaches the sum of X and Smin is the melting temperature by the ½ method.

The measurement sample used is prepared by subjecting 1.2 g of the sample to compression molding for 60 seconds at 10 MPa in a 25° C. environment using a tablet compression molder (Standard Manual Newton Press NT-100H, NPa System Co., Ltd.) to provide a cylindrical shape with a diameter of 8 mm.

The specific measurement procedure follows the procedure in the manual provided with the instrument.

The measurement conditions with the CFT-500D are as follows.

test mode: ramp-up method
start temperature: 60° C.
saturated temperature: 200° C.
measurement interval: 1.0° C.
ramp rate: 4.0° C./min
piston cross section area: 1.000 $cm^2$
test load (piston load): 5.0 kgf
preheating time: 300 seconds
diameter of die orifice: 1.0 mm
die length: 1.0 mm Silicone Compound The silicone compound used as a release agent in the present invention is described in the following. There are no particular limitations on the silicone compound, but a silicone compound having an SP value difference from the olefin resin of at least 5 is preferred. Silicone oils are a favorable example of the silicone compound. Silicone oils can be exemplified by dimethylsilicone oil, alkyl-modified silicone oil (for example, methylphenylsilicone oil, methylhydrogensilicone oil), α-methylstyrene-modified silicone oil, chlorophenyl silicone oil, and fluorine-modified silicone oil. Dimethylsilicone oil, alkyl-modified silicone oil, and so forth are preferred.

Among the preceding, dimethylsilicone oil is preferred because it has the lowest compatibility with the olefin resin and exhibits an excellent release performance. The viscosity of the silicone oil at 25° C. is preferably 10 to 500 centistokes.

The content of the silicone compound is from 1 mass part to 42 mass parts per 100 mass parts of the resin component. A releasing effect is exhibited during fixing by having at least 1 mass part. By specifying not more than 42 mass parts, the exposure of excess silicone compound at the toner particle surface is suppressed and impaired charge retention by the toner due to the silicone compound can be prevented. From 5 mass parts to 25 mass parts is more preferred because this more strongly prevents an impaired release performance and reductions in the charge retention.

The content of the silicone compound in the toner can be measured, for example, using the following method. The toner is dissolved in toluene that has been heated to 90° C. and the insoluble matter is separated by filtration. The filtrate is then cooled to 65° C., and, while stirring, hexane heated to 65° C. is added dropwise to cause the precipitation of insoluble matter. The precipitate is separated by filtration, and the dissolved component is then cooled to 25° C. and the precipitate is separated by filtration to obtain the hexane-dissolved silicone compound. The silicone compound is separated from the hexane by distillation of the latter under reduced pressure, and the content in the toner can then be acquired by measuring the mass of the obtained silicone compound.

The weight-average molecular weight (also referred to hereafter as Mw) of the silicone compound as measured by gel permeation chromatography (GPC) must be from 1,000 to 25,000. By having the weight-average molecular weight be at least 1,000, a low compatibility between the silicone compound and the olefin resin can be brought about and the hot offset resistance is improved. In addition, by having the weight-average molecular weight be not more than 25,000, the silicone compound can then rapidly exude into between the toner particle and fixing members during fixing and the hot offset resistance is improved. From 3,000 to 20,000 is more preferred, which serves to further improve the hot offset resistance.

The content in the silicone compound, in the molecular weight distribution as measured by GPC, of the component having a weight-average molecular weight of not more than 500 must be not more than 0.05 mass %. By specifying not more than 0.05 mass %, precipitation of the silicone compound at the toner particle surface can be inhibited and the storability and charge retention are improved.

The reason for this is thought to be as follows. The low molecular weight silicone compound having a molecular weight of not more than 500 has a high compatibility with the olefin resin and a high mobility in the toner particle, and it is thought that, because of this, this low molecular weight silicone compound specifically precipitates at the toner particle surface, ultimately causing a decline in the charging performance and a reduction in the flowability. Moreover, it is thought that, when the low molecular weight silicone compound is present in the toner particle at or in excess of a certain amount, the high molecular weight silicone compound that is the main component also presents an increased mobility and readily precipitates at the surface.

The content of the component having a weight-average molecular weight of not more than 500 is preferably not more than 0.03 mass %. While there is no particular limitation on the lower limit, it is preferably at least 0.001 mass %.

There are no particular limitations on the method for bringing the content in the silicone compound of the component having a weight-average molecular weight of not more than 500 to 0.05 mass % or less, and known methods can be used. A reduced-pressure heating procedure is provided below as an example.

Reduced-Pressure Heating Procedure

The silicone compound is introduced into a container that provides a tight seal, and heating is carried out at a temperature at which the high molecular weight component of the silicone compound used does not undergo thermal oxidation. The low molecular weight component can be more rapidly depleted at higher heating temperatures, but the heating temperature should be a temperature at which the high molecular weight component does not undergo thermal oxidation. The low molecular weight component can be more efficiently removed by reducing the pressure—using, for example, a vacuum pump—in combination with the application of heat. When pressure reduction is carried out, the pressure is preferably reduced to 10 torr or less, and lower pressures are more advantageous. The reduced-pressure heating is finished once the component having a weight-average molecular weight of not more than 500 has reached 0.05 mass % or less, and recovery is then performed.

The weight-average molecular weight and the molecular weight distribution can be measured using gel permeation chromatography (GPC) as described in the following.

The silicone compound and toluene for HPLC are introduced into a sample vial and dissolution is carried out.

After dissolution of the silicone compound has been confirmed, filtration is performed using a Sample Pretreatment Cartridge (aperture=0.5 μm) from Tosoh Corporation and the filtrate is used as the GPC sample.

The sample solution is adjusted to a concentration of approximately 1.0 mass %.

The measurement is run using the following conditions and this sample solution.

instrument: Prominence GPC system (Shimadzu Corporation)
detector: RID
column: toluene-qualified LF-804×2
temperature: 45.0° C.
solvent: toluene for HPLC
flow rate: 1.0 mL/min
injection amount: 0.05 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the silicone compound.

When Measurement is Carried Out from the Toner

The GPC measurement can also be run on silicone compound that has been separated from the toner using the following method. The toner is dissolved in toluene that has been heated to 90° C. and the insoluble matter is separated by filtration. The filtrate is then cooled to 65° C., and, while stirring, hexane heated to 65° C. is added dropwise to cause the precipitation of insoluble matter. The precipitate is separated by filtration, and the dissolved component is then cooled to 25° C. and the precipitate is separated by filtration to obtain the hexane-dissolved silicone compound. The silicone compound is separated from the hexane by distillation of the latter under reduced pressure, and the obtained silicone compound is then submitted to the GPC measurement.

In addition, the amount of Si in the Si—C bond in the toner particle as measured by ESCA x-ray photoelectric spectrophotometry is preferably from 5.0 atm % to 10.0 atm % with reference to the total elements detected between the binding energies of 94 eV and 540 eV. From 7.0 atm % to 9.0 atm % is more preferred.

This shows the amount of the silicone compound that is present at the toner particle surface. When the amount of Si in the Si—C bond is in the indicated range, this means that the amount of the silicone compound present at the toner particle surface is then controlled into the appropriate range and a silicone compound thin film can be uniformly formed at the toner particle surface. As a result, the charge at the toner particle surface is diffused, the electrostatic attachment force by the toner for the electrostatic latent image bearing member is reduced, and a high transfer efficiency is obtained.

A value of at least 5.0 atm % means that a favorable silicone compound thin film can be formed on the toner particle surface. As a result, the charge at the toner surface is diffused and the electrostatic attachment force by the toner for the electrostatic latent image bearing member then assumes a favorable level and a high transfer efficiency is obtained.

When, on the other hand, this value is not more than 10.0 atm %, the amount of the silicone compound is then not excessive and a high transfer efficiency is obtained because the charge at the toner surface is diffused and the electrostatic attachment force assumes a favorable level.

The amount of Si in the Si—C bond can be controlled through the weight-average molecular weight of the silicone compound, the amount of low molecular weight silicone compound in the silicone compound, and the amount of silicone compound incorporated in the toner.

The following method is used to measure the amount of Si in the Si—C bond by ESCA.

instrument: Quantum 2000 (Ulvac-Phi, Inc.)
sample measurement range: 100 μm 0
photoelectron extraction angle: 45°
x-ray: 50 μl, 12.5 W, 15 kV
pass energy: 46.95 eV
step size: 0.200 eV
no. of sweeps: 1 to 20
measurement range: 94 to 540 eV
measurement time setting: 30 min The measurement principle is as follows: photoelectrons are produced using an x-ray source and the energy is measured based on the chemical bonding inherent to the substance. The measurement is run using monochromated Al-Kα for the x-rays and conditions of a beam diameter of 50 μm and a pass energy of 46.95 eV. The peak area for each element obtained here is corrected using the sensitivity factor, which considers the ease of production of the photoelectrons for each, and this is followed by quantitation of the amount of Si by calculating the percentage for the amount of the element Si with respect to the amount of the elements for all of the peaks.

When silica is externally added as an inorganic fine particle to the toner, the area must be determined by additionally assigning the peak areas for the Si atom to the silicone compound-originating and silica-originating peaks. These assignments are made using the different binding energies.

Specifically, the silicone compound has a peak originating with the Si—C bond between the binding energies of 101 eV and 102 eV, while silica has a peak originating with $SiO_2$ between 103 eV and 104 eV. Based on this, the determination can be carried out by assigning the peak area for the Si atom in the Si—C bond to the area for the particular binding energy.

Olefin Copolymer Including Acid Group

Viewed from the perspective of the adherence of the toner to paper and the eraser resistance, the resin component preferably contains an olefin copolymer including acid group having an acid value of from 50 mg KOH/g to 300 mg KOH/g (preferably from 50 mg KOH/g to 250 mg KOH/g). This olefin copolymer including acid group preferably contains the carboxy group. The carboxy groups in the olefin copolymer including acid group form hydrogen bonds with the hydroxyl groups in the paper surface, thereby raising the adherence between the toner and paper and providing the fixed material with resistance to erasure with an eraser.

In the present invention, the olefin copolymer including acid group is a polymer that has a polyolefin (a structure represented by formula (1)), such as polyethylene or polypropylene, as its main component, and into which monomer having an acid group, e.g., acrylic acid, methacrylic acid, maleic acid, maleic anhydride, itaconic acid, vinyl sulfonate, and so forth, has been introduced by a means such as, for example, copolymerization, so the polymer also bears an acid group. Structures other than the polyolefin and acid group may also be incorporated to the degree that the properties are not affected.

The content of structures other than the polyolefin and acid group, expressed with reference to the overall mass of the olefin copolymer including acid group, is preferably from 0 mass % to 20 mass %, more preferably from 0 mass % to 10 mass %, and still more preferably from 0 mass % to 5 mass %, and is particularly preferably substantially 0 mass %.

Viewed from the standpoint of the fixing performance, an acid group-bearing polymer in which the main component is polyethylene is preferred, and, considering the adherence to paper, the acid group preferably is a structure derived from acrylic acid or methacrylic acid. That is, an ethylene-acrylic acid copolymer and an ethylene-methacrylic acid copolymer are preferred from the standpoint of bringing about an improvement in the adherence between the toner and paper.

The content of the olefin copolymer including acid group, expressed with reference to the overall mass of the resin component, is preferably from 10 mass % to 50 mass % and is more preferably from 10 mass % to 30 mass %. An excellent adherence to paper is provided at 10 mass % and above. On the other hand, there is little environmental-based fluctuation in the charging performance at 50 mass % and below.

The acid value of the olefin copolymer including acid group is preferably from 50 mg KOH/g to 300 mg KOH/g and is more preferably from 80 mg KOH/g to 200 mg KOH/g. A satisfactory adherence to paper is exhibited by having the acid value be at least 50 mg KOH/g, while the charging performance is enhanced by having the acid value be not more than 300 mg KOH/g.

The acid value is the number of milligrams of potassium hydroxide required to neutralize the acid component, such as free fatty acid and resin acid, present in 1 g of a sample. With regard to the measurement method, measurement is carried out as follows with reference to JIS K 0070-1992.

(1) Reagents

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the pulverized sample is exactly weighed into a 200-mL Erlenmeyer flask and 100 mL of a toluene/ethanol (2:1) mixed solution is added and dissolution is carried out over 5 hours. Several drops of the phenolphthalein solution are added as indicator and titration is performed using the potassium hydroxide solution. The titration endpoint is taken to be the persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

Separation of the Olefin Copolymer Including Ester Group and Olefin Copolymer Including Acid Group from the Toner Properties such as the content and acid value can also be measured by separating the olefin resin from the toner using the following method.

The toner is dissolved in toluene that has already been heated to 90° C., and the insoluble matter is separated by filtration. The filtrate is then cooled to 65° C. and, while stirring, hexane heated to 65° C. is added dropwise to induce the precipitation of insoluble matter. The precipitate is separated by filtration, and the precipitate is dissolved in tetrahydrofuran. The content of the olefin resin blend can be measured by separating the insoluble matter from the dissolved matter by filtration and thoroughly drying the insoluble matter. In addition, the blending ratio can be measured using high-performance liquid chromatography (HPLC) on the obtained olefin resin blend.

The melt flow rate of the olefin copolymer including acid group is preferably not more than 200 g/10 min, which serves to suppress blocking during storage. Moreover, viewed from the standpoint of the adherence between the toner and paper, the melt flow rate of the olefin copolymer including acid group is preferably at least 10 g/10 min. At 10 g/10 min and above, miscibilization with the olefin resin is facilitated and an excellent adherence to paper is provided.

The melt flow rate of the olefin copolymer including acid group can be measured by the same method as for the melt flow rate of the olefin copolymer including ester group.

Viewed from the perspectives of the low-temperature fixability and storability, the melting point of the olefin copolymer including acid group is preferably from 50° C. to 100° C. The low-temperature fixability is further improved by having the melting point be not more than 100° C. The low-temperature fixability is improved still further by having the melting point be not more than 90° C. On the other hand, an excellent storability is provided when the melting point is at least 50° C.

To the extent that the effects of the present invention are not impaired, the toner according to the present invention may additionally contain, for its resin component (binder resin), polymer other than the olefin resin and olefin copolymer including acid group. Specifically, for example, the following polymers may be used:

homopolymers of styrene and its substituted forms, e.g., polystyrene, poly-p-chlorostyrene, and polyvinyltoluene; styrene copolymers, e.g., styrene-p-chlorostyrene copolymer, styrene-vinyltoluene copolymer, styrene-vinylnaphthalene copolymer, styrene-acrylate ester copolymers, and styrene-methacrylate ester copolymers; as well as polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyethylene resins, and polypropylene resins.

Plasticizer (Aliphatic Hydrocarbon Compound)

Viewed from the standpoint of the low-temperature fixability, the toner particle preferably contains an aliphatic hydrocarbon compound at, per 100 mass parts of the resin component, preferably from 1 mass part to 40 mass parts and more preferably from 10 mass parts to 30 mass parts. The melting point of the aliphatic hydrocarbon compound is preferably from 50° C. to 100° C. and is more preferably from 60° C. to 80° C.

The aliphatic hydrocarbon compound can plasticize the olefin resin when heat is applied. As a consequence, through the incorporation of the aliphatic hydrocarbon compound in the toner particle, the olefin resin, which forms a matrix, plasticizes the toner particle during heat fixing and the low-temperature fixability can then be improved.

Moreover, an aliphatic hydrocarbon compound having a melting point from 50° C. to 100° C. also functions as a nucleating agent for the olefin resin. As a consequence, the micromobility of the olefin resin is inhibited and the charging performance is improved. Viewed in terms of the low-temperature fixability and the charging performance, the content of the aliphatic hydrocarbon compound is more preferably from 10 mass parts to 30 mass parts.

The aliphatic hydrocarbon compound can be specifically exemplified by aliphatic hydrocarbons having from 20 to 60 carbons, e.g., hexacosane, triacosane, and hexatriacosane.

The content of the aliphatic hydrocarbon compound in the toner can be measured, for example, using the following method.

The toner is dissolved in toluene that has been heated to 90° C. and the insoluble matter is separated by filtration. The filtrate is then cooled to 65° C. and, while stirring, hexane heated to 65° C. is added dropwise to induce the precipitation of insoluble matter. The precipitate is separated by filtration, and the dissolved component is then cooled to 25° C. to induce the precipitation of the aliphatic hydrocarbon compound. The precipitated aliphatic hydrocarbon compound is recovered by filtration and dried and its mass is then measured.

Colorant

The toner may contain a colorant. Examples of the colorant are provided in the following. The black colorant can be exemplified by carbon black and by colorants provided by color mixing a yellow colorant, magenta colorant, and cyan colorant to give a black color. A pigment may be used by itself for the colorant; however, the use of a dye/pigment combination brings about an improved sharpness and is thus more preferred from the standpoint of the quality of the full-color image.

Pigments for magenta toners can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; and C. I. Vat Red 1, 2, 10, 13, 15, 23, 29, and 35.

Dyes for magenta toners can be exemplified by the following: oil-soluble dyes such as C. I. Solvent Red 1, 3, 8, 23, 24, 25, 27, 30, 49, 81, 82, 83, 84, 100, 109, and 121; C. I. Disperse Red 9; C. I. Solvent Violet 8, 13, 14, 21, and 27; and C. I. Disperse Violet 1, and by basic dyes such as C. I.

Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28.

Pigments for cyan toners can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which from 1 to 5 phthalimidomethyl groups are substituted on the phthalocyanine skeleton.

Dyes for cyan toners can be exemplified by C. I. Solvent Blue 70.

Pigments for yellow toners can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Dyes for yellow toners can be exemplified by C. I. Solvent Yellow 162.

A single one of these colorants may be used or a mixture may be used, and these colorants may also be used in a solid solution state. The colorant is selected considering the hue angle, chroma, lightness, lightfastness, OHP transparency, and dispersibility in the toner.

The content of the colorant is preferably from 1 mass part to 20 mass parts per 100 mass parts of the resin component.

Viewed from the standpoint of obtaining a high-definition image, the median diameter on a volume basis of the toner is preferably from 3.0 μm to 10.0 μm and is more preferably from 4.0 μm to 7.0 μm.

Toner Production Methods

A known method, e.g., a suspension polymerization method, kneading pulverization method, emulsion aggregation method, and dissolution suspension method, can be used as the method for producing the toner according to the present invention.

The dissolution suspension method and emulsion aggregation method are specifically described below as toner production methods, but there is no limitation to these.

Dissolution Suspension Method

The dissolution suspension method is a method in which the resin component, the silicone compound, and optionally a colorant and so forth are dissolved or dispersed in an organic solvent; the obtained solution or dispersion is dispersed, into approximately the size of the toner particle, in a poor solvent, e.g., water; and, while in this state, the organic solvent is distillatively removed to produce the toner particle.

The toner is produced by the dissolution suspension method via a resin dissolution step, a granulation step, a solvent removal step, and a washing and drying step.

Resin Dissolution Step

The resin dissolution step is a step in which, for example, the olefin resin and silicone compound are dissolved in an organic solvent with heating to prepare a resin composition. Another resin, a plasticizer, a colorant, a release agent, and so forth may also be dissolved or dispersed on an optional basis.

Any organic solvent that dissolves the resin can be used as the organic solvent used here. Specific examples are toluene and xylene.

The amount of use of the organic solvent is not limited, but should be an amount that provides a viscosity that enables the resin composition to undergo dispersion and granulation in the aqueous medium. Specifically, the mass ratio between the resin composition containing the olefin resin, silicone compound, and optionally other resin, plasticizer, colorant, and so forth, and the organic solvent is preferably 10/90 to 50/50 from the standpoints of the granulation performance and the toner production efficiency.

On the other hand, the silicone compound and colorant need not undergo dissolution in the organic solvent and may be dispersed. When the silicone compound and colorant are employed in a dispersed state, the dispersion is preferably performed using a disperser such as a bead mill.

Granulation Step

The granulation step is a step in which the obtained resin composition is dispersed, using a dispersing agent, in an aqueous medium so as to provide the prescribed toner particle diameter and prepare a dispersion (granulate). Mainly water is used for the aqueous medium. In addition, the aqueous medium preferably contains from 1 mass % to 30 mass % of a monovalent metal salt. The incorporation of the monovalent metal salt functions to inhibit the diffusion of the organic solvent in the resin composition into the aqueous medium and to facilitate obtaining an excellent particle size distribution by the toner.

The monovalent metal salt can be exemplified by sodium chloride, potassium chloride, lithium chloride, and potassium bromide, where among sodium chloride and potassium chloride are preferred.

In addition, the mixing ratio (mass ratio) between the aqueous medium and resin composition is preferably an aqueous medium/resin composition=90/10 to 50/50.

There are no particular limitations on the dispersing agent, but a cationic, anionic, or nonionic surfactant is used as an organic dispersing agent, with anionic surfactants being preferred. Examples here sodium alkylbenzenesulfonate, sodium α-olefinsulfonate, sodium alkylsulfonate, and sodium alkyl diphenyl ether disulfonate. Inorganic dispersing agents, on the other hand, can be exemplified by tricalcium phosphate, hydroxyapatite, calcium carbonate, titanium oxide, and silica powder.

The inorganic dispersing agent tricalcium phosphate is preferred among the preceding. This is due to its granulation performance and stability and because it has very little negative effect on the properties of the resulting toner.

The amount of addition of the dispersing agent is determined in conformity to the particle diameter of the granulate, and larger amounts of dispersing agent addition provide smaller particle diameters. Due to this, the amount of addition for the dispersing agent will vary depending on the desired particle diameter, but 0.1 to 15 mass parts per 100 mass parts of the resin composition is preferred. The production of coarse particles is suppressed at 0.1 mass part and above, while the production of unwanted microfine particles is suppressed at 15 mass parts and below.

The preparation of the dispersion of the resin composition in the aqueous medium is preferably carried out under high-speed shear. Granulation preferably is carried out to provide a weight-average particle diameter of not more than 10 μm for the dispersion of the resin composition dispersed in the aqueous medium, while granulation to approximately 4 to 9 μm is preferred.

The apparatus for applying high-speed shear can be exemplified by various high-speed dispersers and ultrasound dispersers.

On the other hand, the weight-average particle diameter of the dispersion can be measured using a particle size distribution analyzer based on the Coulter method (Coulter Multisizer III: Coulter Co.).

Solvent Removal Step

The solvent removal step is a step of removing the organic solvent from the obtained dispersion. Removal of the organic solvent is preferably performed while carrying out stirring. The organic solvent removal rate can also be controlled by the application of heat and reduced pressure as necessary.

Washing and Drying Step

After the solvent removal step, a washing and drying step may be executed in which washing is performed a plurality of times with, e.g., water, and the toner particles are then filtered off and dried. When a dispersing agent that dissolves under acidic conditions, e.g., tricalcium phosphate, has been used as the dispersing agent, preferably washing with, e.g., hydrochloric acid, is carried out followed by washing with water. The execution of washing serves to remove the dispersing agent used for granulation and can thereby improve the properties of the toner.

After washing, the toner particle can be obtained by filtration and drying. The obtained toner particle may be used as such as a toner. Or, the toner may be obtained by the optional addition to the toner particle, by the application of shear force in a dry state, of inorganic fine particles, e.g., silica, alumina, titania, calcium carbonate, and so forth, and/or resin particles, e.g., of a vinyl resin, polyester resin, silicone resin, and so forth. These inorganic fine particles and resin particles function as an external additive, e.g., a charging auxiliary agent, a flowability auxiliary agent, a cleaning auxiliary agent, and so forth.

Emulsion Aggregation Method

The emulsion aggregation method is a production method in which the toner particle is produced by preliminarily preparing a dispersion of resin fine particles that are sufficiently smaller than the target particle diameter and inducing the aggregation of these resin fine particles in an aqueous medium.

Toner is produced in the emulsion aggregation method through a step of preparing a resin fine particle dispersion, an aggregation step, a fusion step, a cooling step, and a washing step. A toner production method using the emulsion aggregation method is specifically described in the following, but this should not be construed as a limitation thereto.

Step of Preparing Resin Fine Particle Dispersion

Resin fine particles are first prepared in the emulsion aggregation method. The resin fine particles can be produced by a known method, but production by the following method is preferred.

The olefin resin is dissolved in an organic solvent to form a uniform solution. After this, a basic compound and surfactant are added on an optional basis. The solution is then added to an aqueous medium to induce the formation of fine particles. The solvent is removed to obtain a resin fine particle dispersion in which resin fine particles are dispersed.

More specifically, the olefin resin is dissolved in an organic solvent with heating and a surfactant and/or base is added on an optional basis. Then, while applying shear using, for example, a homogenizer, an aqueous medium is gradually added to induce the formation of resin fine particles, or formation of the resin fine particles is brought about by the application of shear using, for example, a homogenizer, after the addition of the aqueous medium. The solvent is then removed under the application of heat or reduced pressure to produce a resin fine particle dispersion.

The concentration of the olefin resin when dissolved in the organic solvent is preferably from 10 mass % to 50 mass % and is more preferably from 30 mass % to 50 mass %. Any organic solvent capable of dissolving the olefin resin may be used, but solvents in which the olefin resin exhibits a high solubility, e.g., toluene, xylene, ethyl acetate, and so forth, are preferred.

There are no particular limitations on the surfactant. The following are examples: anionic surfactants such as the salts of sulfate esters, sulfonate salts, carboxylate salts, phosphate esters, and soaps; cationic surfactants such as amine salts and quaternary ammonium salts; and nonionic surfactants such as polyethylene glycols, ethylene oxide adducts on alkylphenols, and polyhydric alcohol systems.

The base can be exemplified by inorganic bases such as sodium hydroxide and potassium hydroxide and by organic bases such as triethylamine, trimethylamine, dimethylaminoethanol, and diethylaminoethanol. A single species of base may be used by itself or two or more species may be used in combination.

The resin fine particles preferably have a median diameter on a volume basis of 0.05 to 1.0 μm and more preferably 0.1 to 0.6 μm. A toner particle having a desirable particle diameter is easily obtained when the median diameter is in the indicated range. The median diameter on a volume basis can be measured using a dynamic light scattering particle size distribution analyzer (Nanotrac UPA-EX150, Nikkiso Co., Ltd.).

A fine particle dispersion of the silicone compound is preferably prepared. A fine particle dispersion containing the olefin resin and silicone compound may be prepared by mixing with the olefin resin, or a fine particle dispersion (emulsion) of only the silicone compound may be prepared. When a fine particle dispersion is prepared by mixing, a fine particle dispersion containing the olefin resin and silicone compound is obtained by adding the silicone compound when the olefin resin is dissolved in organic solvent in the step of preparing a resin fine particle dispersion. When the fine particle dispersion (emulsion) is prepared by itself, a silicone compound dispersion of the silicone compound dispersed in an aqueous medium is obtained by mixing the silicone compound and surfactant with an aqueous medium followed by the application of shear using, for example, a homogenizer.

Aggregation Step

The aggregation step is a step in which a mixture is prepared by mixing an optional colorant fine particle dispersion with the fine particle dispersion containing the olefin resin and silicone compound or with the resin fine particle dispersion and the silicone compound dispersion, and the particles present in the obtained mixture are then aggregated to form aggregated particles. In a preferred example of the method for inducing formation of the aggregated particles, for example, an aggregating agent is added to and mixed into the mixture and the temperature is raised and/or, for example, mechanical force is suitably applied.

The colorant fine particle dispersion used on an optional basis in the aggregation step is prepared by the dispersion of a colorant as described above. The colorant fine particles are dispersed using a known method, but the use is preferred of, for example, a rotary shear homogenizer; a media-based disperser such as a ball mill, sand mill, or attritor; or a high-pressure countercollision disperser. A surfactant or polymeric dispersing agent that supports dispersion stability can also be added on an optional basis.

The aggregating agent used in the aggregation step can be exemplified by the metal salts of monovalent metals such as sodium, potassium, and so forth; metal salts of divalent metals such as calcium, magnesium, and so forth; metal salts of trivalent metals such as iron, aluminum, and so forth; and polyvalent metal salts such as polyaluminum chloride. Viewed from the standpoint of the ability to control the particle diameter in the aggregation step, divalent metal salts, e.g., calcium chloride, magnesium sulfate, and so forth, are preferred.

The addition and mixing of the aggregating agent is preferably carried out in the temperature range from room temperature (25° C.) to 75° C. When mixing is performed using this temperature condition, it proceeds in a state in which the aggregation is stable. Mixing can be carried out using, for example, a known mixing apparatus, homogenizer, mixer, and so forth.

The average particle diameter of the aggregated particles formed in the aggregation step is not particularly limited, but generally should be controlled to a volume-average particle diameter of 4.0 to 7.0 μm so as to be approximately equal to the average particle diameter of the toner particle that is ultimately to be obtained. This control can be readily exercised by, for example, suitably setting and changing the temperature and stirring and mixing conditions during the addition and mixing of the aggregating agent and so forth. The particle size distribution of the aggregated particles can be measured using a particle size distribution analyzer based on the Coulter method (Coulter Multisizer III: Coulter Company).

Fusion Step

The fusion step is a step of producing—by heating and fusing the aggregated particle at at least the melting point of the olefin resin—a particle in which the surface of the aggregated particle has been smoothed out. In order to prevent particle-to-particle melt adhesion, for example, a chelating agent, pH modifier, surfactant, and so forth can be added as appropriate prior to entry into the primary fusion step.

The chelating agent can be exemplified by ethylenediaminetetraacetic acid (EDTA) and its alkali metal salts, for example, its Na salt; sodium gluconate; sodium tartrate; potassium citrate and sodium citrate; nitrilotriacetate (NTA) salts; and highly water-soluble polymers that contain both the COOH and OH functionalities (polyelectrolytes).

The heating temperature should be at least the melting point of the olefin resin present in the aggregate, but less than the temperature at which the olefin resin undergoes thermal decomposition. With regard to the heating and fusion time, shorter times are sufficient at higher heating temperatures, while longer times are required at lower heating temperatures. That is, the heating and fusion time cannot be unconditionally specified because it depends on the heating temperature; however, it is generally 10 minutes to 10 hours.

Cooling Step

The cooling step is a step in which the temperature of the aqueous medium containing the particles produced in the fusion step is cooled to a temperature below the crystallization temperature of the olefin resin. The generation of coarse particles can be suppressed by carrying out cooling to a temperature below this crystallization temperature. The specific cooling rate is 0.1 to 50° C./minute.

In addition, an annealing—wherein crystallization is promoted by holding at a temperature at which the olefin resin (preferably olefin copolymer including ester group) has a rapid crystallization rate—is preferably carried out during cooling or after cooling. Crystallization is promoted by holding at a temperature of approximately 30° C. to 70° C.

Washing Step

Impurities in the toner particle can be removed by subjecting the particle produced via the preceding steps to repeated washing and filtration. Specifically, the toner particle preferably is washed using an aqueous solution containing a chelating agent, e.g., ethylenediaminetetraacetic acid (EDTA) or its sodium salt, and preferably is also washed with pure water. The metal salts and surfactant in the toner particle can be removed by repeating filtration and washing with pure water a plurality of times. The number of filtrations is preferably 3 to 20 times from the standpoint of the production efficiency, while 3 to 10 times is more preferred.

Drying Step

The toner particle can be obtained by drying the particle yielded by the preceding steps. The obtained toner particle can be used as such as a toner. The toner may also be prepared by the optional addition of an external additive. The external additive can be exemplified by inorganic particles of, e.g., silica, alumina, titania, calcium carbonate, and so forth, and by resin particles of, e.g., a vinyl resin, polyester resin, silicone resin, and so forth. These can be added, for example, by the application of shear force in the dry state. These inorganic particles and resin particles function as external additives, e.g., a flowability auxiliary agent, cleaning auxiliary, and so forth.

EXAMPLES

The present invention is described in additional detail in the following using examples and comparative examples, but the present invention is not limited to or by these. Unless specifically indicated otherwise, the number of parts in the examples and comparative examples is on a mass basis in all instances.

Production of Low Molecular Weight-Depleted Silicone Compound A silicone compound A 100 parts (dimethylsilicone oil, Shin-Etsu Chemical Co., Ltd.: KF96-500CS, kinematic viscosity at 25° C.=500 $mm^2/s$, Mw=20,000)

Silicone compound A was introduced into a 500-mL recovery flask and the low molecular weight component was depleted using an R-100 rotary evaporator (BUCHI). A low molecular weight-depleted silicone compound A was obtained by carrying out a 3-hour treatment by heating to 180° C. on an oil bath and reducing the pressure to 10 torr while rotating at 100 rpm. The weight-average molecular weight was 20,000, and the component with a weight-average molecular weight of 500 or less was 0.03 mass % of the silicone compound.

Production of Low Molecular Weight-Depleted Silicone Compound B

A low molecular weight-depleted silicone compound B was obtained proceeding as in the method for producing low molecular weight-depleted silicone compound A, but changing the silicone compound A to silicone compound B (dimethylsilicone oil, Shin-Etsu Chemical Co., Ltd.: KF96-10CS, kinematic viscosity at 25° C.=10 $mm^2/s$, Mw=1,100). The weight-average molecular weight was 1,200, and the component with a weight-average molecular weight of 500 or less was 0.05 mass % of the silicone compound.

Production of Low Molecular Weight-Depleted Silicone Compound C

A low molecular weight-depleted silicone compound C was obtained proceeding as in the method for producing low molecular weight-depleted silicone compound A, but changing the silicone compound A to silicone compound C (dimethylsilicone oil, Shin-Etsu Chemical Co., Ltd.: KF96-50CS, kinematic viscosity at 25° C.=50 $mm^2/s$, Mw=4,000). The weight-average molecular weight was 4,200, and the component with a weight-average molecular weight of 500 or less was 0.04 mass % of the silicone compound.

Production of Low Molecular Weight-Depleted Silicone Compound D

A low molecular weight-depleted silicone compound D was obtained proceeding as in the method for producing low molecular weight-depleted silicone compound A, but changing the silicone compound A to silicone compound D (dimethylsilicone oil, Shin-Etsu Chemical Co., Ltd.: KF96-100CS, kinematic viscosity at 25° C.=100 $mm^2/s$, Mw=7,900). The weight-average molecular weight was 8,000, and the component with a weight-average molecular weight of 500 or less was 0.04 mass % of the silicone compound.

Production of Low Molecular Weight-Depleted Silicone Compound E

A low molecular weight-depleted silicone compound E was obtained proceeding as in the method for producing low molecular weight-depleted silicone compound A, but changing the silicone compound A to silicone compound E (dimethylsilicone oil, Shin-Etsu Chemical Co., Ltd.: KF96A-6CS, kinematic viscosity at 25° C.=6 $mm^2/s$, Mw=800). The weight-average molecular weight was 900, and the component with a weight-average molecular weight of 500 or less was 0.05 mass % of the silicone compound.

Production of Low Molecular Weight-Depleted Silicone Compound F

A low molecular weight-depleted silicone compound F was obtained proceeding as in the method for producing low molecular weight-depleted silicone compound A, but changing the silicone compound A to silicone compound F (dimethylsilicone oil, Shin-Etsu Chemical Co., Ltd.: KF96-1000CS, kinematic viscosity at 25° C.=1,000 $mm^2/s$, Mw=27,000). The weight-average molecular weight was 27,000, and the component with a weight-average molecular weight of 500 or less was 0.03 mass % of the silicone compound.

Production of Resin Fine Particle 1 Dispersion toluene (Wako Pure Chemical Industries, Ltd.) 300 parts olefin resin A 75 parts (ethylene-vinyl acetate copolymer EVA (ester group concentration: 8 mass %, acid value=0 mg KOH/g, weight-average molecular weight: 110,000, melt flow rate: 12 g/10 min, melting point: 86° C., elongation at break=700%, (1+m+n)/Z1=1.00))

low molecular weight-depleted silicone compound A 20 parts olefin copolymer including acid group A 25 parts (ethylene-methacrylic acid copolymer, melt flow rate: 60 g/10 min, melting point=90° C., acid value=90 mg KOH/g)

This formulation was mixed and was dissolved at 90° C.

Separately, 2.9 parts of sodium dodecylbenzenesulfonate, 1.0 parts of sodium laurate, and 2.9 parts of N,N-dimethylaminoethanol were added to 700 parts of deionized water and dissolution was performed by heating at 90° C. The aforementioned toluene solution and the aqueous solution were then mixed and stirring was carried out at 7,000 rpm using a T. K. Robomix ultrahigh-speed stirrer (PRIMIX Corporation). Emulsification was also performed at a pressure of 200 MPa using a Nanomizer high-pressure impact-type disperser (Yoshida Kikai Co., Ltd.). This was followed by removal of the toluene using an evaporator and adjustment of the concentration with deionized water to obtain an aqueous dispersion having a concentration of resin fine particle 1 of 20 mass % (resin fine particle 1 dispersion).

Measurement of the median diameter on a volume basis of the resin fine particle 1 using a dynamic light-scattering particle size distribution analyzer (Nanotrac: Nikkiso Co., Ltd.) gave 0.35 μm.

Production of Resin Fine Particle 2 Dispersion

A resin fine particle 2 dispersion was obtained proceeding as in the method for the production of the resin fine particle 1 dispersion, but changing the low molecular weight-depleted silicone compound A to the low molecular weight-depleted silicone compound B. The median diameter on a volume basis of the obtained resin fine particle 2 was 0.31 μm.

Production of Resin Fine Particle 3 Dispersion

A resin fine particle 3 dispersion was obtained proceeding as in the method for the production of the resin fine particle 1 dispersion, but changing the low molecular weight-depleted silicone compound A to the low molecular weight-depleted silicone compound C. The median diameter on a volume basis of the obtained resin fine particle 3 was 0.38 μm.

Production of Resin Fine Particle 4 Dispersion

A resin fine particle 4 dispersion was obtained proceeding as in the method for the production of the resin fine particle 1 dispersion, but changing the low molecular weight-depleted silicone compound A to the low molecular weight-depleted silicone compound D. The median diameter on a volume basis of the obtained resin fine particle 4 was 0.33

Production of Resin Fine Particle 5 Dispersion

A resin fine particle 5 dispersion was obtained proceeding as in the method for the production of the resin fine particle 1 dispersion, but changing the olefin resin A to an olefin resin B (ethylene-ethyl acrylate copolymer EEA (ester group concentration: 11 mass %, acid value=0 mg KOH/g, melt flow rate: 20 g/10 min, melting point: 91° C., elongation at break=900%, (1+m+n)/Z1=1.00)). The median diameter on a volume basis of the obtained resin fine particle 5 was 0.31 μm.

Production of Resin Fine Particle 6 Dispersion

A resin fine particle 6 dispersion was obtained proceeding as in the method for the production of the resin fine particle 1 dispersion, but changing the olefin resin A to an olefin resin C (ethylene-1-butene copolymer (1-butene percentage: 16 mass %, acid value=0 mg KOH/g, melting point: 77° C., elongation at break=900%, (m+n)/W=1.00)). The median diameter on a volume basis of the obtained resin fine particle 6 was 0.43 μm.

Production of Resin Fine Particle 7 Dispersion

A resin fine particle 7 dispersion was obtained proceeding as in the method for the production of the resin fine particle 1 dispersion, but changing the amount of the low molecular weight-depleted silicone compound A to 38.5 parts. The median diameter on a volume basis of the obtained resin fine particle 7 was 0.32

Production of Resin Fine Particle 8 Dispersion

A resin fine particle 8 dispersion was obtained proceeding as in the method for the production of the resin fine particle 1 dispersion, but changing the olefin copolymer including acid group A to an olefin copolymer including acid group B (ethylene-methacrylic acid copolymer, melt flow rate: 35 g/10 min, melting point=86° C., acid value=60 mg KOH/g) and changing the amount of the sodium dodecylbenzenesulfonate to 1.9 parts. The median diameter on a volume basis of the obtained resin fine particle 8 was 0.40 μm.

Production of Resin Fine Particle 9 Dispersion

A resin fine particle 9 dispersion was obtained proceeding as in the method for the production of the resin fine particle 1 dispersion, but changing the olefin copolymer including acid group A to an olefin copolymer including acid group C (ethylene-methacrylic acid copolymer, melt flow rate: 5 g/10 min, melting point=88° C., acid value=273 mg KOH/g) and changing the amount of the sodium dodecylbenzenesulfonate to 9.5 parts. The median diameter on a volume basis of the obtained resin fine particle 9 was 0.33 μm.

Production of Resin Fine Particle 10 Dispersion

A resin fine particle 10 dispersion was obtained proceeding as in the method for the production of the resin fine particle 1 dispersion, but changing the olefin copolymer including acid group A to an olefin copolymer including acid group D (ethylene-methacrylic acid copolymer, melt flow rate: 10 g/10 min, melting point=95° C., acid value=186 mg KOH/g) and changing the amount of the sodium dodecylbenzenesulfonate to 5.9 parts. The median diameter on a volume basis of the obtained resin fine particle 10 was 0.37 μm.

Production of Resin Fine Particle 11 Dispersion

A resin fine particle 11 dispersion was obtained proceeding as in the method for the production of the resin fine particle 1 dispersion, but changing the olefin copolymer including acid group A to an olefin copolymer including acid group E (ethylene-methacrylic acid copolymer, melt flow rate: 33 g/10 min, melting point=95° C., acid value=33 mg KOH/g) and changing the amount of the sodium dodecylbenzenesulfonate to 1.0 parts. The median diameter on a volume basis of the obtained resin fine particle 11 was 0.49 μm.

Production of Resin Fine Particle 12 Dispersion

A resin fine particle 12 dispersion was obtained proceeding as in the method for the production of the resin fine particle 1 dispersion, but changing the olefin copolymer including acid group A to an olefin copolymer including acid group F (ethylene-methacrylic acid copolymer, melt flow rate: 5 g/10 min, melting point=80° C., acid value=354 mg KOH/g) and changing the amount of the sodium dodecylbenzenesulfonate to 11.2 parts. The median diameter on a volume basis of the obtained resin fine particle 12 was 0.36 μm.

Production of Resin Fine Particle 13 Dispersion

A resin fine particle 13 dispersion was obtained proceeding as in the method for the production of the resin fine particle 1 dispersion, but changing the amount of the olefin resin A to 55 parts, changing the amount of the olefin copolymer including acid group A to 45 parts, and changing the amount of the sodium dodecylbenzenesulfonate to 6.4 parts. The median diameter on a volume basis of the obtained resin fine particle 13 was 0.25 μm.

Production of Resin Fine Particle 14 Dispersion

A resin fine particle 14 dispersion was obtained proceeding as in the method for the production of the resin fine particle 1 dispersion, but changing the amount of the low molecular weight-depleted silicone compound A to 5 parts. The median diameter on a volume basis of the obtained resin fine particle 14 was 0.35 μm.

Production of Resin Fine Particle 15 Dispersion

A resin fine particle 15 dispersion was obtained proceeding as in the method for the production of the resin fine particle 1 dispersion, but changing the amount of the low molecular weight-depleted silicone compound A to 10 parts. The median diameter on a volume basis of the obtained resin fine particle 15 was 0.35 μm.

Production of Resin Fine Particle 16 Dispersion

A resin fine particle 16 dispersion was obtained proceeding as in the method for the production of the resin fine particle 1 dispersion, but changing the amount of the low molecular weight-depleted silicone compound A to 40 parts. The median diameter on a volume basis of the obtained resin fine particle 16 was 0.32 μm.

Production of Resin Fine Particle 17 Dispersion

A resin fine particle 17 dispersion was obtained proceeding as in the method for the production of the resin fine particle 1 dispersion, but changing the low molecular weight-depleted silicone compound A to the silicone compound A that had not been subjected to a low molecular weight depletion treatment. The median diameter on a volume basis of the obtained resin fine particle 17 was 0.36 μm.

Production of Resin Fine Particle 18 Dispersion

A resin fine particle 18 dispersion was obtained proceeding as in the method for the production of the resin fine particle 1 dispersion, but changing the low molecular weight-depleted silicone compound A to the silicone compound B that had not been subjected to a low molecular weight depletion treatment. The median diameter on a volume basis of the obtained resin fine particle 18 was 0.33 μm.

Production of Resin Fine Particle 19 Dispersion

A resin fine particle 19 dispersion was obtained proceeding as in the method for the production of the resin fine particle 1 dispersion, but changing the low molecular weight-depleted silicone compound A to the silicone compound C that had not been subjected to a low molecular weight depletion treatment. The median diameter on a volume basis of the obtained resin fine particle 19 was 0.30 μm.

Production of Resin Fine Particle 20 Dispersion

A resin fine particle 20 dispersion was obtained proceeding as in the method for the production of the resin fine particle 1 dispersion, but changing the low molecular weight-depleted silicone compound A to the silicone compound D that had not been subjected to a low molecular weight depletion treatment. The median diameter on a volume basis of the obtained resin fine particle 20 was 0.37 μm.

Production of Resin Fine Particle 21 Dispersion

A resin fine particle 21 dispersion was obtained proceeding as in the method for the production of the resin fine particle 1 dispersion, but changing the low molecular weight-depleted silicone compound A to the low molecular weight-depleted silicone compound E. The median diameter on a volume basis of the obtained resin fine particle 21 was 0.30 μm.

Production of Resin Fine Particle 22 Dispersion

A resin fine particle 22 dispersion was obtained proceeding as in the method for the production of the resin fine particle 1 dispersion, but changing the low molecular weight-depleted silicone compound A to the low molecular weight-depleted silicone compound F. The median diameter on a volume basis of the obtained resin fine particle 22 was 0.51 μm.

Production of Resin Fine Particle 23 Dispersion

A resin fine particle 23 dispersion was obtained proceeding as in the method for the production of the resin fine particle 1 dispersion, but omitting the low molecular weight-depleted silicone compound A. The median diameter on a volume basis of the obtained resin fine particle 23 was 0.34 μm.

Production of Resin Fine Particle 24 Dispersion

A resin fine particle 24 dispersion was obtained proceeding as in the method for the production of the resin fine particle 1 dispersion, but changing the amount of the low molecular weight-depleted silicone compound A to 60 parts. The median diameter on a volume basis of the obtained resin fine particle 24 was 0.39 μm.

Production of Resin Fine Particle 25 Dispersion tetrahydrofuran (Wako Pure Chemical Industries, Ltd.) 400 parts polyester resin 240 parts

[composition (molar ratio) (polyoxypropylene(2.2)-2,2-bis (4-hydroxyphenyl)propane:isophthalic acid:terephthalic acid=100:50:50), number-average molecular weight (Mn) =4,600, weight-average molecular weight (Mw)=16,500, peak molecular weight (Mp)=10,400, glass transition temperature (Tg)=70° C., acid value: 13 mg KOH/g] anionic surfactant (Neogen R K, Dai-ichi Kogyo Seiyaku Co., Ltd.) 1.4 parts After the preceding had been mixed, stirring was carried out for 12 hours to effect dissolution of the resin.

3.8 parts of N,N-dimethylaminoethanol was then added and stirring was carried out at 4,000 rpm using a T. K. Robomix ultrahigh-speed stirrer (PRIMIX Corporation).

Resin fine particles were subsequently precipitated by the addition of 800 parts of deionized water at a rate of 8 g/min. This was followed by removal of the tetrahydrofuran using an evaporator to obtain a resin fine particle 25 dispersion having a concentration of 30 mass %. The median diameter on a volume basis of the obtained resin fine particle 25 was 0.15 μm.

Production of a Colorant Fine Particle Dispersion colorant 10.0 parts (cyan pigment, Dainichiseika Color & Chemicals Mfg. Co., Ltd.: Pigment Blue 15:3)

anionic surfactant (Neogen R K, Dai-ichi Kogyo Seiyaku Co., Ltd.) 1.5 parts deionized water 88.5 parts The preceding were mixed with dissolution, and dispersion was then carried out for approximately 1 hour using a Nanomizer high-pressure impact-type disperser (Yoshida Kikai Co., Ltd.) to prepare an aqueous dispersion of colorant fine particles in which the colorant was dispersed at a concentration of 10 mass % (colorant fine particle dispersion). The median diameter on a volume basis of the obtained colorant fine particles was measured at 0.20 μm using a dynamic light-scattering particle size distribution analyzer (Nanotrac: Nikkiso Co., Ltd.).

Production of an Aliphatic Hydrocarbon Compound Fine Particle 1 Dispersion aliphatic hydrocarbon compound A (HNP-51, melting point=78° C., Nippon Seirro Co., Ltd.)

(Neogen R K, Dai-ichi Kogyo Seiyaku Co., Ltd.)

deionized water 79.0 parts

The preceding were introduced into a mixing container equipped with a stirrer and were then heated to 90° C. and a dispersion treatment was carried out for 60 minutes by circulation to a Clearmix W-Motion (M Technique Co., Ltd.). The following dispersion conditions were used.

rotor outer diameter=3 cm clearance=0.3 mm rotor rpm=19,000 rpm screen rpm=19,000 rpm After the dispersion treatment, an aqueous dispersion containing an aliphatic hydrocarbon compound fine particle 1 at a concentration of 20 mass % (aliphatic hydrocarbon compound fine particle 1 dispersion) was obtained by cooling to 40° C. using the following cooling process conditions: rotor rpm=1,000 rpm, screen rpm=0 rpm, and cooling rate=10° C./minute. The 50% particle diameter on a volume basis (d50) of the aliphatic hydrocarbon compound fine particle 1 was measured at 0.15 μm using a dynamic light-scattering particle size distribution analyzer (Nanotrac, Nikkiso Co., Ltd.).

Production of an Aliphatic Hydrocarbon Compound Fine Particle 2 Dispersion

An aliphatic hydrocarbon compound fine particle 2 dispersion was obtained proceeding as in the method for producing the aliphatic hydrocarbon compound fine particle 1 dispersion, but changing the aliphatic hydrocarbon compound A to an aliphatic hydrocarbon compound B (Paraffin Wax-125, melting point=53° C., Nippon Seiro Co., Ltd.). The median diameter on a volume basis of the obtained aliphatic hydrocarbon compound fine particle 2 was 0.13 μm.

Production of an Aliphatic Hydrocarbon Compound Fine Particle 3 Dispersion

An aliphatic hydrocarbon compound fine particle 3 dispersion was obtained proceeding as in the method for producing the aliphatic hydrocarbon compound fine particle 1 dispersion, but changing the aliphatic hydrocarbon compound A to an aliphatic hydrocarbon compound C (FNP0090, melting point=93° C., Nippon Seiro Co., Ltd.) and changing the heating temperature to 95° C. The median diameter on a volume basis of the obtained aliphatic hydrocarbon compound fine particle 3 was 0.19 μm.

Production of an Aliphatic Hydrocarbon Compound Fine Particle 4 Dispersion

An aliphatic hydrocarbon compound fine particle 4 dispersion was obtained proceeding as in the method for producing the aliphatic hydrocarbon compound fine particle 1 dispersion, but changing the aliphatic hydrocarbon compound A to an aliphatic hydrocarbon compound D (Paraffin Wax-115, melting point=48° C., Nippon Seiro Co., Ltd.). The median diameter on a volume basis of the obtained aliphatic hydrocarbon compound fine particle 4 was 0.12 μm.

Production of Silicone Compound Emulsion low molecular weight-depleted silicone compound A 20.0 parts anionic surfactant (Neogen R K, Dai-ichi Kogyo Seiyaku Co., Ltd.) 1.0 parts deionized water 79.0 parts The preceding were mixed and subjected to dispersion for approximately 1 hour using a Nanomizer high-pressure impact-type disperser (Yoshida Kikai Co., Ltd.) to prepare an aqueous dispersion in which the silicone compound was dispersed at a silicone compound concentration of 20 mass %. The median diameter on a volume basis of the silicone compound particles in the obtained silicone compound emulsion was measured at 0.09 μm using a dynamic light-scattering particle size distribution analyzer (Nanotrac, Nikkiso Co., Ltd.).

Example 1 resin fine particle 1 dispersion 600 parts colorant fine particle dispersion 80 parts aliphatic hydrocarbon compound fine particle 1 dispersion 150 parts deionized water 160 parts The preceding substances were introduced into a round stainless steel flask and were mixed, followed by the addition of 60 parts of a 10 mass % aqueous solution of magnesium sulfate. Dispersion was subsequently carried out for 10 minutes at 5,000 rpm using a homogenizer (IKA: Ultra-Turrax T50). Then, heating was carried out to 73° C. on a heating water bath while using a stirring blade and suitably adjusting the rotation rate so as to stir the mixture. After holding for 20 minutes at 73° C., it was confirmed, using a Coulter Multisizer III, for the volume-average particle diameter of the aggregated particles formed that aggregated particles having a volume-average particle diameter of approximately 6.0 μm had been formed.

330 parts of a 5 mass % aqueous sodium ethylenediaminetetraacetate solution was additionally added to this aggregated particle dispersion followed by heating to 98° C. while continuing to stir. The aggregated particles were fused by holding for 1 hour at 98° C.

This was followed by cooling to 50° C. and holding for 3 hours to promote crystallization of the ethylene-vinyl acetate copolymer. This was followed by cooling to 25° C. and solid-liquid separation by filtration; then washing of the filter cake with a 0.5 mass % aqueous sodium ethylenediaminetetraacetate solution; and washing with deionized water. After the completion of washing, a toner particle with a median diameter on a volume basis of 5.4 μm was obtained by drying using a vacuum dryer.

A toner was obtained by dry mixing 1.5 parts of hydrophobed silica fine particles having a primary particle diameter of 10 nm and 2.5 parts of hydrophobed silica fine particles having a primary particle diameter of 100 nm with 100 parts of the obtained toner particle using a Henschel mixer (Mitsui Mining Co., Ltd.). The components and properties of the obtained toner are given in Tables 1-1 and 1-2.

Example 2

A toner was obtained proceeding as in Example 1, but changing the resin fine particle 1 dispersion to the resin fine particle 2 dispersion. The obtained toner particle had a median diameter on a volume basis of 5.2 μm.

Example 3

A toner was obtained proceeding as in Example 1, but changing the resin fine particle 1 dispersion to the resin fine particle 3 dispersion. The obtained toner particle had a median diameter on a volume basis of 5.3 μm.

Example 4

A toner was obtained proceeding as in Example 1, but changing the resin fine particle 1 dispersion to the resin fine particle 4 dispersion. The obtained toner particle had a median diameter on a volume basis of 5.1 μm.

Example 5

A toner was obtained proceeding as in Example 1, but changing the resin fine particle 1 dispersion to the resin fine particle 5 dispersion. The obtained toner particle had a median diameter on a volume basis of 5.5 μm.

Example 6

A toner was obtained proceeding as in Example 1, but changing the resin fine particle 1 dispersion to the resin fine particle 6 dispersion. The obtained toner particle had a median diameter on a volume basis of 5.3 μm.

Example 7

A toner was obtained proceeding as in Example 1, but changing the resin fine particle 1 dispersion to 360 parts of the resin fine particle 7 dispersion and 160 parts of the resin fine particle 25 dispersion. The obtained toner particle had a median diameter on a volume basis of 6.2 μm.

Example 8

A toner was obtained proceeding as in Example 1, but changing the resin fine particle 1 dispersion to the resin fine particle 8 dispersion. The obtained toner particle had a median diameter on a volume basis of 5.2 μm.

Example 9

A toner was obtained proceeding as in Example 1, but changing the resin fine particle 1 dispersion to the resin fine particle 9 dispersion. The obtained toner particle had a median diameter on a volume basis of 5.9 μm.

Example 10

A toner was obtained proceeding as in Example 1, but changing the resin fine particle 1 dispersion to the resin fine particle 10 dispersion. The obtained toner particle had a median diameter on a volume basis of 5.5 μm.

Example 11

A toner was obtained proceeding as in Example 1, but changing the resin fine particle 1 dispersion to the resin fine particle 11 dispersion. The obtained toner particle had a median diameter on a volume basis of 5.3 μm.

Example 12

A toner was obtained proceeding as in Example 1, but changing the resin fine particle 1 dispersion to the resin fine particle 12 dispersion. The obtained toner particle had a median diameter on a volume basis of 5.5 μm.

Example 13

A toner was obtained proceeding as in Example 1, but changing the resin fine particle 1 dispersion to the resin fine particle 13 dispersion. The obtained toner particle had a median diameter on a volume basis of 5.6 μm.

Example 14

A toner was obtained proceeding as in Example 1, but changing the resin fine particle 1 dispersion to the resin fine particle 14 dispersion and using 525 parts for the amount of the dispersion. The obtained toner particle had a median diameter on a volume basis of 5.4 μm.

Example 15

A toner was obtained proceeding as in Example 1, but changing the resin fine particle 1 dispersion to the resin fine particle 15 dispersion and using 550 parts for the amount of the dispersion. The obtained toner particle had a median diameter on a volume basis of 5.1 μm.

Example 16

A toner was obtained proceeding as in Example 1, but changing the resin fine particle 1 dispersion to the resin fine particle 16 dispersion and using 700 parts for the amount of the dispersion. The obtained toner particle had a median diameter on a volume basis of 5.0 μm.

Example 17

A toner was obtained proceeding as in Example 1, but changing the aliphatic hydrocarbon compound fine particle 1 dispersion to the aliphatic hydrocarbon compound fine particle 2 dispersion. The obtained toner particle had a median diameter on a volume basis of 5.3 μm.

Example 18

A toner was obtained proceeding as in Example 1, but changing the aliphatic hydrocarbon compound fine particle 1 dispersion to the aliphatic hydrocarbon compound fine particle 3 dispersion. The obtained toner particle had a median diameter on a volume basis of 5.7 μm.

Example 19

A toner was obtained proceeding as in Example 1, but changing the aliphatic hydrocarbon compound fine particle 1 dispersion to the aliphatic hydrocarbon compound fine particle 4 dispersion. The obtained toner particle had a median diameter on a volume basis of 5.1

Example 20

A toner was obtained proceeding as in Example 1, but changing the amount of the aliphatic hydrocarbon compound fine particle 1 dispersion to 50 parts. The obtained toner particle had a median diameter on a volume basis of 5.1 μm.

Example 21

A toner was obtained proceeding as in Example 1, but changing the amount of the aliphatic hydrocarbon compound fine particle 1 dispersion to 200 parts. The obtained toner particle had a median diameter on a volume basis of 5.3 μm.

Example 22

A toner was obtained proceeding as in Example 1, but changing the amount of the aliphatic hydrocarbon compound fine particle 1 dispersion to 250 parts. The obtained toner particle had a median diameter on a volume basis of 5.2 μm.

Comparative Example 1

A toner was obtained proceeding as in Example 1, but changing the resin fine particle 1 dispersion to the resin fine particle 17 dispersion. The obtained toner particle had a median diameter on a volume basis of 5.1 μm.

Comparative Example 2

A toner was obtained proceeding as in Example 1, but changing the resin fine particle 1 dispersion to the resin fine particle 18 dispersion. The obtained toner particle had a median diameter on a volume basis of 5.3 μm.

Comparative Example 3

A toner was obtained proceeding as in Example 1, but changing the resin fine particle 1 dispersion to the resin fine particle 19 dispersion. The obtained toner particle had a median diameter on a volume basis of 5.5

Comparative Example 4

A toner was obtained proceeding as in Example 1, but changing the resin fine particle 1 dispersion to the resin fine particle 20 dispersion. The obtained toner particle had a median diameter on a volume basis of 5.0 μm.

Comparative Example 5

A toner was obtained proceeding as in Example 1, but changing the resin fine particle 1 dispersion to the resin fine particle 21 dispersion. The obtained toner particle had a median diameter on a volume basis of 5.2 μm.

Comparative Example 6

A toner was obtained proceeding as in Example 1, but changing the resin fine particle 1 dispersion to the resin fine particle 22 dispersion. The obtained toner particle had a median diameter on a volume basis of 5.5 μm.

Comparative Example 7

A toner was obtained proceeding as in Example 1, but changing the resin fine particle 1 dispersion to the resin fine particle 23 dispersion and using 500 parts for the amount of the dispersion. The obtained toner particle had a median diameter on a volume basis of 5.1 μm.

Comparative Example 8

A toner was obtained proceeding as in Example 1, but changing the resin fine particle 1 dispersion to the resin fine particle 24 dispersion and using 800 parts for the amount of the dispersion. The obtained toner particle had a median diameter on a volume basis of 5.1 μm.

Comparative Example 9

A toner was obtained proceeding as in Example 1, but changing the resin fine particle 1 dispersion to 300 parts of the resin fine particle 16 dispersion and 200 parts of the resin fine particle 25 dispersion. The obtained toner particle had a median diameter on a volume basis of 5.6 μm.

Comparative Example 10 resin fine particle 25 dispersion 333 parts
colorant fine particle dispersion 80 parts
silicone compound emulsion 100 parts
deionized water 387 parts The preceding substances were introduced into a round stainless steel flask and were mixed, followed by the addition of 100 parts of a 2 mass % aqueous solution of magnesium sulfate. Dispersion was subsequently carried out for 10 minutes at 5,000 rpm using a homogenizer (IKA: Ultra-Turrax T50). Then, heating was carried out to 54° C. on a heating water bath while using a stirring blade and suitably adjusting the rotation rate so as to stir the mixture. After holding for 1 hour at 54° C., it was confirmed, using a Coulter Multisizer III for the volume-average particle diameter of the aggregated particles formed, that aggregated particles having a volume-average particle diameter of approximately 6.3 μm had been formed.

400 parts of a 5 mass % aqueous sodium ethylenediaminetetraacetate solution was additionally added to this aggregated particle dispersion followed by heating to 98° C. while continuing to stir. The aggregated particles were fused by holding for 2 hours at 98° C.

Then, heating was carried out to 54° C. on a heating water bath while using a stirring blade and suitably adjusting the rotation rate so as to stir the mixture. Holding for 1 hour at 54° C. yielded aggregated particles having a volume-average particle diameter of approximately 6.1 μm.

Water was then introduced into the water bath to cool the aqueous dispersion of toner particles to 25° C.; solid-liquid separation was performed by filtration; the filter cake was thoroughly washed with deionized water; and a toner was obtained by drying using a vacuum dryer. The obtained toner particle had a median diameter on a volume basis of 5.8 μm.

The following evaluation tests were carried out on the toners described above. The results of the evaluations are given in Table 2.

Evaluation of the Low-Temperature Fixability

A two-component developer was prepared for each toner by mixing the toner, so as to provide a toner concentration of 8 mass %, with a ferrite carrier (average particle diameter=42 μm) obtained by coating the surface of a carrier core with a silicone resin.

An unfixed toner image (0.6 mg/cm') was formed on an image-receiving paper (64 g/m$^2$) using a commercial full-color digital copier (CLC1100, Canon, Inc.). The fixing unit was removed from a commercial full-color digital copier (imageRUNNER ADVANCE C5051, Canon, Inc.) and was modified to enable adjustment of the fixation temperature, and this was used to carry out a fixing test on the unfixed image. Operating at normal temperature and normal humidity (temperature=25° C., relative humidity=50% RH) and with the process speed set to 246 mm/s, the unfixed image was fixed and its status was visually evaluated. A score of B or better was regarded as excellent.

A: Fixing could be performed at a temperature of 110° C. or less.

B: Fixing could be performed at a temperature higher than 110° C. and less than or equal to 130° C.

C: Fixing could be performed at a temperature higher than 130° C. and less than or equal to 200° C., or there was no temperature region in which fixing could be performed.

Evaluation of the Charge Retention Percentage 0.01 g of the particular toner was weighed into an aluminum pan and was charged to −600 V using a scorotron charging device. Fluctuations in the surface potential were then measured using a surface potential meter (Model 347, Trek Japan Co., Ltd.) for 30 minutes in an environment with a temperature of 30° C. and a humidity of 80%. The charge retention percentage was calculated using the following formula and the results of the measurement. A score of B or better was regarded as excellent.

charge retention percentage after 30 minutes (%)= (surface potential after 30 minutes/initial surface potential)×100

A: The charge retention percentage is at least 90%.

B: The charge retention percentage is less than 90% and is at least 50%.

C: The charge retention percentage is less than 50% and is at least 10%.

D: The charge retention percentage is less than 10%.

Evaluation of the Storability (Blocking Resistance)

Each toner was held at quiescence for 3 days in a thermostat/humidistat under conditions of a temperature of 50° C. and a humidity of 50%, after which the degree of blocking was visually evaluated. A score of B or better was regarded as excellent.

A: Blocking is not produced, or, when blocking is produced, dispersion is easily carried out by light shaking.

B: Blocking is produced, but dispersion is achieved by continuing to shake.

C: Blocking is produced and dispersion is not achieved even with the application of force.

Evaluation of the Hot Offset Resistance

A two-component developer prepared as described in the "Evaluation of the Low-Temperature Fixability" was used in each case.

For the evaluation, an unfixed toner image (0.1 mg/cm$^2$) was formed on an image-receiving paper (64 g/m$^2$) using a commercial full-color digital copier (CLC1100, Canon, Inc.). The fixing unit was removed from a commercial full-color digital copier (imageRUNNER ADVANCE C5051, Canon, Inc.) and was modified to enable adjustment of the fixation temperature, and this was used to carry out a fixing test on the unfixed toner image.

Operating in an environment with a room temperature of 23° C. and a humidity of 5% RH and with the process speed set to 357 mm/s, the unfixed toner image was fixed and its status was visually evaluated. A score of B or better was regarded as excellent.

A: Hot offset is produced at a temperature higher than 160° C., or hot offset is not produced up to 200° C.

B: Hot offset is produced at a temperature higher than 140° C., but less than or equal to 160° C.

C: Hot offset is produced at a temperature higher than 130° C., but less than or equal to 140° C.

D: Hot offset is produced at a temperature less than or equal to 130° C.

Transfer Efficiency paper: CS-680 (68.0 g/m$^2$) (purchased from Canon Marketing Japan Inc.) evaluation image: placement of a 2 cm×5 cm image in the center of the aforementioned A4 paper toner laid-on level on the paper: 0.35 mg/cm' (FFh image)

(adjusted using the direct-current voltage $V_{DC}$ at the developer carrying member, the charging voltage $V_D$ at the electrostatic latent image bearing member, and the laser power)

test environment: high-temperature, high-humidity environment (temperature=30° C./humidity=80% RH (H/H below))

In order to stabilize the machine used for the evaluation and carry out an evaluation of the durability, 10,000 prints were output on the A4 paper using a strip chart having an image ratio of 0.1%. This was followed by formation of the aforementioned evaluation image on the electrostatic latent image bearing member and transfer to the intermediate transfer member, but the evaluation machine was stopped prior to transfer to the recording paper. The intermediate transfer member in the stopped evaluation machine was taken out; a transparent pressure-sensitive adhesive tape was applied to the transferred image; and the toner was recovered and was applied to the recording paper along with the pressure-sensitive adhesive tape. The image density was measured using an optical densitometer, and the transfer density A was determined by subtracting the density at a location were only the pressure-sensitive adhesive tape was applied to the recording paper.

In addition, the electrostatic latent image bearing member was removed from the evaluation machine and an untransferred density B for the untransferred toner was also determined by the same method. Transparent, weakly adhesive SuperStik (Lintec Corporation) was used for the pressure-sensitive adhesive tape, and an X-Rite color reflection densitometer (X-Rite, Incorporated) was used for the optical densitometer. The transfer efficiency was calculated using the formula given below. The obtained transfer efficiency was evaluated according to the evaluation criteria given below. A score of D or better was regarded as excellent.

$$\text{transfer efficiency}=\{\text{transfer density } A/(\text{transfer density } A+\text{untransferred density } B)\}\times 100$$

(Evaluation Criteria)

A: The transfer efficiency is at least 98.0%.

B: The transfer efficiency is less than 98.0% and is at least 95.0%.

C: The transfer efficiency is less than 95.0% and is at least 92.0%.

D: The transfer efficiency is less than 92.0% and is at least 90.0%.

E: The transfer efficiency is less than 90.0%.

TABLE 1-1

| | | olefin resin | | | | | | silicone compound | | | |
|---|---|---|---|---|---|---|---|---|---|---|---|
| Example No. | fine particle No. | type | ester group concentration mass % | acid value | MFR | melting point ° C. | elongation at break % | type | X mass % | kinematic viscosity $mm^2/S$ | Mw after treatment |
| 1 | 1 | EVA | 8 | 0 | 12 | 86 | 700 | A | 0.03 | 500 | 20000 |
| 2 | 2 | EVA | 8 | 0 | 12 | 86 | 700 | B | 0.05 | 10 | 1200 |
| 3 | 3 | EVA | 8 | 0 | 12 | 86 | 700 | C | 0.04 | 50 | 4200 |
| 4 | 4 | EVA | 8 | 0 | 12 | 86 | 700 | D | 0.04 | 100 | 8000 |
| 5 | 5 | EEA | 11 | 0 | 20 | 91 | 900 | A | 0.03 | 500 | 20000 |
| 6 | 6 | α-olefin | 0 | 0 | 12 | 77 | 900 | A | 0.03 | 500 | 20000 |
| 7 | 7 + 25 | EVA | 8 | 0 | 12 | 86 | 700 | A | 0.03 | 500 | 20000 |
| 8 | 8 | EVA | 8 | 0 | 12 | 86 | 700 | A | 0.03 | 500 | 20000 |
| 9 | 9 | EVA | 8 | 0 | 12 | 86 | 700 | A | 0.03 | 500 | 20000 |
| 10 | 10 | EVA | 8 | 0 | 12 | 86 | 700 | A | 0.03 | 500 | 20000 |
| 11 | 11 | EVA | 8 | 0 | 12 | 86 | 700 | A | 0.03 | 500 | 20000 |
| 12 | 12 | EVA | 8 | 0 | 12 | 86 | 700 | A | 0.03 | 500 | 20000 |
| 13 | 13 | EVA | 8 | 0 | 12 | 86 | 700 | A | 0.03 | 500 | 20000 |
| 14 | 14 | EVA | 8 | 0 | 12 | 86 | 700 | A | 0.03 | 500 | 20000 |
| 15 | 15 | EVA | 8 | 0 | 12 | 86 | 700 | A | 0.03 | 500 | 20000 |
| 16 | 16 | EVA | 8 | 0 | 12 | 86 | 700 | A | 0.03 | 500 | 20000 |
| 17 | 1 | EVA | 8 | 0 | 12 | 86 | 700 | A | 0.03 | 500 | 20000 |
| 18 | 1 | EVA | 8 | 0 | 12 | 86 | 700 | A | 0.03 | 500 | 20000 |
| 19 | 1 | EVA | 8 | 0 | 12 | 86 | 700 | A | 0.03 | 500 | 20000 |
| 20 | 1 | EVA | 8 | 0 | 12 | 86 | 700 | A | 0.03 | 500 | 20000 |
| 21 | 1 | EVA | 8 | 0 | 12 | 86 | 700 | A | 0.03 | 500 | 20000 |
| 22 | 1 | EVA | 8 | 0 | 12 | 86 | 700 | A | 0.03 | 500 | 20000 |
| C. E. 1 | 17 | EVA | 8 | 0 | 12 | 86 | 700 | A | 0.06 | 500 | 20000 |
| C. E. 2 | 18 | EVA | 8 | 0 | 12 | 86 | 700 | B | 5.0 | 10 | 1100 |
| C. E. 3 | 19 | EVA | 8 | 0 | 12 | 86 | 700 | C | 0.2 | 50 | 4000 |
| C. E. 4 | 20 | EVA | 8 | 0 | 12 | 86 | 700 | D | 0.1 | 100 | 7900 |
| C. E. 5 | 21 | EVA | 8 | 0 | 12 | 86 | 700 | E | 0.05 | 6 | 900 |
| C. E. 6 | 22 | EVA | 8 | 0 | 12 | 86 | 700 | F | 0.03 | 1000 | 27000 |
| C. E. 7 | 23 | EVA | 8 | 0 | 12 | 86 | 700 | | | none | |
| C. E. 8 | 24 | EVA | 8 | 0 | 12 | 86 | 700 | A | 0.03 | 500 | 20000 |
| C. E. 9 | 16 + 25 | EVA | 8 | 0 | 12 | 86 | 700 | A | 0.03 | 500 | 20000 |
| C. E. 10 | 25 | — | — | — | — | — | — | A | 0.03 | 500 | 20000 |

In the Table 1-1, "C.E." indicates "comparative example" and "X" indicates "the content of a component having a weight-average molecular weight of not more than 500".

TABLE 1-2

| | | mass % of olefin copolymer | number of parts per 100 parts of the resin component | | |
|---|---|---|---|---|---|
| Example No. | mass % of olefin resin in the resin component | including acid group in the resin component | silicone compound | aliphatic hydro-carbon compound | Si amount atm % |
| 1 | 75 | 25 | 20 | 30 | 8.0 |
| 2 | 75 | 25 | 20 | 30 | 9.8 |
| 3 | 75 | 25 | 20 | 30 | 9.0 |

TABLE 1-2-continued

| | | mass % of olefin copolymer | number of parts per 100 parts of the resin component | | |
|---|---|---|---|---|---|
| Example No. | mass % of olefin resin in the resin component | including acid group in the resin component | silicone compound | aliphatic hydro-carbon compound | Si amount atm % |
| 4 | 75 | 25 | 20 | 30 | 8.6 |
| 5 | 75 | 25 | 20 | 30 | 8.0 |
| 6 | 75 | 25 | 20 | 30 | 7.8 |
| 7 | 39 | 13 | 20 | 30 | 8.2 |
| 8 | 75 | 25 | 20 | 30 | 7.9 |
| 9 | 75 | 25 | 20 | 30 | 8.1 |
| 10 | 75 | 25 | 20 | 30 | 8.0 |
| 11 | 75 | 25 | 20 | 30 | 8.0 |
| 12 | 75 | 25 | 20 | 30 | 8.1 |

TABLE 1-2-continued

| | | mass % of olefin copolymer | number of parts per 100 parts of the resin component | | |
|---|---|---|---|---|---|
| Example No. | mass % of olefin resin in the resin component | including acid group in the resin component | silicone compound | aliphatic hydro-carbon compound | Si amount atm % |
| 13 | 55 | 45 | 20 | 30 | 8.0 |
| 14 | 75 | 25 | 5 | 30 | 4.1 |
| 15 | 75 | 25 | 10 | 30 | 5.2 |

TABLE 1-2-continued

| Example No. | mass % of olefin resin in the resin component | mass % of olefin copolymer including acid group in the resin component | number of parts per 100 parts of the resin component: silicone compound | number of parts per 100 parts of the resin component: aliphatic hydro-carbon compound | Si amount atm % |
|---|---|---|---|---|---|
| 16 | 75 | 25 | 40 | 30 | 9.2 |
| 17 | 75 | 25 | 20 | 30 | 8.0 |
| 18 | 75 | 25 | 20 | 30 | 8.0 |
| 19 | 75 | 25 | 20 | 30 | 8.0 |
| 20 | 75 | 25 | 20 | 10 | 8.0 |
| 21 | 75 | 25 | 20 | 40 | 8.0 |
| 22 | 75 | 25 | 20 | 50 | 7.9 |
| C.E. 1 | 75 | 25 | 20 | 30 | 8.2 |
| C.E. 2 | 75 | 25 | 20 | 30 | 9.9 |
| C.E. 3 | 75 | 25 | 20 | 30 | 9.2 |
| C.E. 4 | 75 | 25 | 20 | 30 | 8.7 |
| C.E. 5 | 75 | 25 | 20 | 30 | 10.2 |
| C.E. 6 | 75 | 25 | 20 | 30 | 6.5 |
| C.E. 7 | 75 | 25 | 0 | 30 | — |
| C.E. 8 | 75 | 25 | 60 | 30 | 10.0 |
| C.E. 9 | 30 | 10 | 20 | 30 | 8.5 |
| C.E. 10 | 0 | 0 | 20 | 0 | 9.0 |

In the Table 1-2, "C.E." indicates "comparative example".

TABLE 2

| Example No. | Result of toner evaluations: low-temperature fixability | charge retention percentage | stor-ability | hot offset resistance | transfer efficiency |
|---|---|---|---|---|---|
| 1 | A | A | A | A | A |
| 2 | A | B | A | A | C |
| 3 | A | A | A | A | B |
| 4 | A | A | A | A | B |
| 5 | B | A | A | A | A |
| 6 | A | A | A | B | A |
| 7 | B | A | A | A | B |
| 8 | B | A | A | A | A |
| 9 | A | B | A | A | B |
| 10 | A | B | A | A | A |
| 11 | B | A | A | A | A |
| 12 | A | B | A | A | B |
| 13 | A | B | A | A | A |
| 14 | A | A | A | B | D |
| 15 | A | A | A | A | D |
| 16 | A | A | A | A | C |
| 17 | A | A | A | A | A |
| 18 | A | A | A | A | A |
| 19 | A | A | B | A | A |
| 20 | B | A | A | A | A |
| 21 | A | A | A | A | A |
| 22 | A | B | B | A | A |
| Comparative Example 1 | A | B | C | B | B |
| Comparative Example 2 | A | C | C | C | E |
| Comparative Example 3 | A | C | C | C | C |
| Comparative Example 4 | A | B | C | C | C |
| Comparative Example 5 | A | C | A | C | E |
| Comparative Example 6 | A | A | A | C | C |
| Comparative Example 7 | A | A | A | C | E |
| Comparative Example 8 | A | C | A | A | E |
| Comparative Example 9 | C | C | A | A | B |

TABLE 2-continued

| Example No. | Result of toner evaluations: low-temperature fixability | charge retention percentage | stor-ability | hot offset resistance | transfer efficiency |
|---|---|---|---|---|---|
| Comparative Example 10 | B | C | A | A | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-195160, filed Oct. 5, 2017, which is hereby incorporated by reference herein in its entirety.

What is claimed is:

1. A toner, comprising:

a toner particle that contains a resin component and a silicone compound, the resin component containing at least 50 mass % of olefin resin, and a content of the silicone compound being 1 to 42 mass parts per 100 mass parts of the resin component, and the silicone compound having a weight-average molecular weight of 1,000 to 25,000 as measured by GPC, wherein a content of a component having a weight-average molecular weight of not more than 500 in a molecular weight distribution of the silicone compound as measured by GPC is not more than 0.05 mass % of the silicone compound.

2. The toner according to claim 1, wherein the olefin resin contains an olefin copolymer including ester group that has an ester group concentration of not more than 18 mass %.

3. The toner according to claim 2, wherein the olefin copolymer including ester group has a structure represented by formula (1), and has at least one species of a second structure selected from the group consisting of formula (2) and formula (3)

(1)

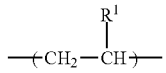

(2)

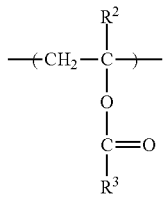

(3)

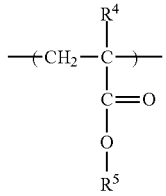

where $R^1$ represents H or $CH_3$, $R^2$ represents H or $CH_3$, $R^3$ represents $CH_3$ or $C_2H_5$, $R^4$ represents H or $CH_3$, and $R^5$ represents $CH_3$ or $C_2H_5$.

4. The toner according to claim 2, wherein the ester group-containing olefin copolymer contains ethylene-vinyl acetate.

5. The toner according to claim 1, wherein the silicone compound contains a silicone oil.

6. The toner according to claim 1, wherein the silicone compound contains a dimethylsilicone oil.

7. The toner according to claim 1, wherein the content of the silicone compound is 5 to 25 mass parts per 100 mass parts of the resin component.

8. The toner according to claim 1, wherein the weight-average molecular weight of the silicone compound is 3,000 to 20,000 as measured by GPC.

9. The toner according to claim 1, wherein the resin component contains an olefin copolymer including acid group that has an acid value of 50 to 300 mg KOH/g, and a content of the olefin copolymer including acid group is 10 to 50 mass %, expressed with reference to an overall mass of the resin component.

10. The toner according to claim 1, wherein the toner particle contains an aliphatic hydrocarbon compound having a melting point of 50 to 100° C., and a content of the aliphatic hydrocarbon compound is 1 to 40 mass parts, per 100 mass parts of the resin component.

11. The toner according to claim 1, wherein an amount of Si in the Si—C bond at the toner particle surface is 5.0 to 10.0 atm % with reference to total elements detected between binding energies of 94 eV and 540 eV, as measured by ESCA x-ray photoelectric spectrophotometry.

12. The toner according to claim 1, wherein the content of the component having a weight-average molecular weight of not more than 500 is not more than 0.03 mass % of the silicone compound.

* * * * *